US009600975B2

(12) United States Patent
Brown et al.

(10) Patent No.: US 9,600,975 B2
(45) Date of Patent: Mar. 21, 2017

(54) CHAIN REACTION KENO

(71) Applicant: IGT, Las Vegas, NV (US)

(72) Inventors: Bradford D. Brown, Sparks, NV (US); Benjamin R. Holsclaw, Sparks, NV (US); Thomas J. Humphrey, Reno, NV (US); David R. Lark, Reno, NV (US); Ronald P. Papson, Reno, NV (US)

(73) Assignee: IGT, Las Vegas, NV (US)

( * ) Notice: Subject to any disclaimer, the term of this patent is extended or adjusted under 35 U.S.C. 154(b) by 537 days.

(21) Appl. No.: 14/033,286

(22) Filed: Sep. 20, 2013

(65) Prior Publication Data

US 2015/0087380 A1 Mar. 26, 2015

(51) Int. Cl.
*G07F 17/32* (2006.01)

(52) U.S. Cl.
CPC ..... *G07F 17/3286* (2013.01); *G07F 17/326* (2013.01); *G07F 17/329* (2013.01)

(58) Field of Classification Search
CPC ..... A63F 3/06; A63F 3/0605; A63F 3/061; A63F 3/062; G07F 17/329; G07F 17/34; G07F 17/3213; G07F 17/3244
See application file for complete search history.

(56) References Cited

U.S. PATENT DOCUMENTS 4,033,588 A 7/1977 Watts
4,611,811 A 9/1986 Haase
4,661,906 A 4/1987 DiFrancesco et al.
4,711,454 A 12/1987 Small
4,747,600 A 5/1988 Richardson
4,775,155 A 10/1988 Lees
4,798,387 A 1/1989 Richardson
4,875,686 A 10/1989 Timms
5,005,840 A 4/1991 Schwartz
5,043,887 A 8/1991 Richardson
5,046,737 A 9/1991 Fienberg
5,072,381 A 12/1991 Richardson et al.
5,100,139 A 3/1992 Di Bella
5,116,049 A 5/1992 Sludikoff et al.
5,158,293 A 10/1992 Mullins
5,351,970 A 10/1994 Fioretti
(Continued)

OTHER PUBLICATIONS

"The Everything Casino Gambling Book," 2nd ed., by Meg Elaine Schneider, 2004, Adams Media, chapter on keno.*

*Primary Examiner* — Omkar Deodhar
*Assistant Examiner* — Matthew D. Hoel
(74) *Attorney, Agent, or Firm* — Neal, Gerber & Eisenberg LLP

(57) ABSTRACT

Gaming systems and methods for providing a keno game during which matches from a previous keno game are carried over to the keno game are described herein. A keno board is displayed having a set of available numbers and a first set of one or more matches identified between player selected numbers and drawn numbers from a previous keno game. A first set of drawn numbers from the set of available numbers is selected. The number of the first set of drawn numbers is modified by number of matches in the first set of matches. The payout to the player is calculated based on the first set of matches and a second set of matches between the first set of drawn numbers and the player selected numbers.

20 Claims, 19 Drawing Sheets

(56) References Cited

U.S. PATENT DOCUMENTS 5,401,024 A 3/1995 Simunek
5,419,592 A 5/1995 Stuart
5,482,289 A 1/1996 Weingardt
5,569,083 A 10/1996 Fioretti
5,586,937 A 12/1996 Menashe
5,639,089 A 6/1997 Matsumoto et al.
5,647,798 A 7/1997 Falciglia
5,651,735 A * 7/1997 Baba ..... G07F 17/3244 463/18
5,679,077 A 10/1997 Pocock et al.
5,687,971 A 11/1997 Khaladkar
5,718,631 A 2/1998 Invencion
5,727,786 A 3/1998 Weingardt
5,743,526 A 4/1998 Inoue
5,755,619 A 5/1998 Matsumoto et al.
5,779,545 A 7/1998 Berg et al.
5,813,911 A 9/1998 Margolin
5,823,534 A 10/1998 Banyai
5,833,537 A * 11/1998 Barrie ..... G07F 17/3265 463/21
5,857,911 A 1/1999 Fioretti
5,871,398 A 2/1999 Schneier et al.
5,909,875 A 6/1999 Weingardt
5,935,001 A 8/1999 Baba
5,935,002 A 8/1999 Falciglia
5,945,655 A 8/1999 Gilgeous et al.
6,017,032 A 1/2000 Grippo et al.
6,024,640 A 2/2000 Walker et al.
6,079,711 A 6/2000 Wei et al.
6,099,407 A 8/2000 Parker et al.
6,102,400 A 8/2000 Scott et al.
6,146,272 A 11/2000 Walker et al.
6,168,521 B1 1/2001 Luciano et al.
6,183,361 B1 2/2001 Cummings et al.
6,210,276 B1 4/2001 Mullins
6,220,961 B1 4/2001 Keane et al.
6,241,606 B1 6/2001 Riendeau et al.
6,250,685 B1 6/2001 Walker et al.
6,257,980 B1 7/2001 Santini, Jr.
6,315,290 B1 11/2001 Roethel et al.
6,315,291 B1 11/2001 Moody
6,325,716 B1 12/2001 Walker et al.
6,358,151 B1 3/2002 Enzminger et al.
6,364,313 B1 4/2002 Moody
6,368,213 B1 4/2002 McNabola
6,368,214 B1 * 4/2002 Luciano ..... A63F 1/00 273/138.1
6,398,644 B1 6/2002 Perrie et al.
6,398,646 B1 6/2002 Wei et al.
6,402,614 B1 6/2002 Schneier et al.
6,425,823 B1 7/2002 Byrne
6,478,677 B1 11/2002 Moody
6,482,088 B2 11/2002 Santini, Jr.
6,514,144 B2 2/2003 Riendeau et al.
6,524,184 B1 2/2003 Lind et al.
6,524,185 B2 2/2003 Lind
6,533,660 B2 3/2003 Seelig et al.
6,565,091 B2 5/2003 Weingardt
6,569,017 B2 5/2003 Enzminger et al.
6,581,935 B1 6/2003 Odom
6,585,590 B2 7/2003 Malone
6,599,188 B2 7/2003 Hirsch et al.
6,607,440 B2 8/2003 Santini, Jr.
6,609,973 B1 8/2003 Weiss
6,645,072 B1 11/2003 Kellen
6,656,044 B1 12/2003 Lewis
6,656,045 B2 12/2003 Wei et al.
6,722,655 B1 4/2004 Camero
6,755,738 B2 6/2004 Glasson et al.
6,755,739 B2 6/2004 Santini, Jr.
6,780,108 B1 8/2004 Luciano et al.
6,802,776 B2 10/2004 Lind et al.
6,824,465 B2 11/2004 Luciano, Jr.
6,832,956 B1 12/2004 Boyd et al.
6,840,858 B2 1/2005 Adams
7,258,608 B2 8/2007 Khal
7,303,469 B2 12/2007 Kaminkow
7,306,519 B2 12/2007 Baerlocher
7,399,227 B2 7/2008 Michaelson et al.
7,544,129 B2 6/2009 Baerlocher
7,682,241 B2 3/2010 Baerlocher
7,824,257 B2 11/2010 Jubinville et al.
7,901,282 B2 3/2011 Cannon
8,025,561 B2 9/2011 Reddicks et al.
2002/0045472 A1 4/2002 Adams
2002/0052231 A1 5/2002 Fioretti
2002/0094859 A1 7/2002 Hirsch et al.
2002/0098883 A1 7/2002 Packes et al.
2002/0111207 A1 8/2002 Lind et al.
2002/0111214 A1 8/2002 Lind et al.
2002/0113369 A1 8/2002 Weingardt
2002/0117803 A1 8/2002 Weingardt
2002/0137562 A1 9/2002 Malone
2002/0155877 A1 10/2002 Enzminger et al.
2002/0169018 A1 11/2002 Schneier et al.
2002/0177478 A1 11/2002 Glasson et al.
2003/0017867 A1 1/2003 DeKeller
2003/0127793 A1 7/2003 Adams
2003/0144050 A1 7/2003 Keaton et al.
2003/0171986 A1 9/2003 Itkis et al.
2003/0178771 A1 9/2003 Banyai
2003/0181234 A1 9/2003 Falciglia, Sr.
2003/0193136 A1 10/2003 Walker et al.
2003/0195032 A1 10/2003 Enzminger et al.
2004/0009806 A1 1/2004 Odom
2004/0048647 A1 3/2004 Lind et al.
2004/0053669 A1 3/2004 Gerrard et al.
2004/0106445 A1 6/2004 Perrie et al.
2004/0121834 A1 6/2004 Libby et al.
2004/0130096 A1 7/2004 Duhamel
2004/0152499 A1 8/2004 Lind et al.
2004/0166920 A1 8/2004 Boyd et al.
2004/0176169 A1 9/2004 Lind et al.
2004/0178579 A1 9/2004 Lowell et al.
2004/0204225 A1 10/2004 Campo et al.
2004/0214626 A1 10/2004 Lind et al.
2004/0235555 A1 11/2004 Yarbrough et al.
2004/0242310 A1 12/2004 Perkins
2004/0251628 A1 12/2004 Kilby
2004/0266509 A1 12/2004 Bennett et al.
2005/0054404 A1 3/2005 Baerlocher
2005/0054415 A1 3/2005 Kaminkow et al.
2005/0059449 A1 3/2005 Yarbrough
2005/0059467 A1 3/2005 Saffari et al.
2005/0059468 A1 3/2005 Cannon
2005/0059469 A1 3/2005 Gail et al.
2005/0059470 A1 3/2005 Cannon
2005/0059471 A1 3/2005 Cannon
2005/0064932 A1 3/2005 Cannon
2005/0075161 A1 4/2005 McGlone et al.
2005/0096119 A1 5/2005 Lind et al.
2005/0096123 A1 5/2005 Cregan et al.
2005/0101370 A1 5/2005 Lind et al.
2005/0101387 A1 5/2005 Wolf
2005/0119042 A1 6/2005 Chamberlain et al.
2005/0130730 A1 6/2005 Lind et al.
2005/0148382 A1 7/2005 Fox
2005/0164771 A1 7/2005 Lind et al.
2005/0164772 A1 7/2005 Lind et al.
2005/0164773 A1 7/2005 Lind et al.
2005/0167916 A1 8/2005 Banyai
2005/0187014 A1 8/2005 Saffari et al.
2005/0227753 A1 10/2005 Luciano, Jr.
2005/0255906 A1 11/2005 Lind et al.
2006/0084490 A1 4/2006 Khal
2006/0189375 A1 8/2006 Dodge
2007/0021185 A1 1/2007 Walker et al.
2007/0117611 A1 5/2007 Dodge
2008/0102952 A1 5/2008 Walker et al.
2008/0254894 A1 10/2008 Michaelson et al.
2009/0075715 A1 3/2009 Coleman et al.
2009/0197664 A1 8/2009 Schultz

(56) References Cited

U.S. PATENT DOCUMENTS

| | | | |
|---|---|---|---|
| 2010/0120489 | A1 | 5/2010 | Meyer |
| 2011/0028201 | A1 | 2/2011 | Warner et al. |

* cited by examiner

CHAIN REACTION KENO

BACKGROUND

The present disclosure relates generally to wager-based games and more particularly to keno games. A keno game typically displays to a player a keno board with eighty numbered selection spots. A player wagers by selecting six numbers on the keno board. Next, twenty numbers are drawn from eighty possible numbers. The player is paid based on matches found between the drawn numbers and the six player-selected numbers on the keno board. For example, the player may have selected numbers 5, 21, 34, 36, 49, and 71 of which 5 and 21 match the numbers drawn by the keno game. A paytable may dictate the payout amount that is due to the player depending on the number of matches detected. For example, a paytable may indicate that if there are four matches, then the payout amount is seven points.

SUMMARY

An exemplary embodiment relates to method providing a keno game during which matches from a previous keno game are carried over to the keno game. The method includes displaying a keno board having a set of available numbers and a first set of one or more matches identified between player selected numbers and drawn numbers from a previous keno game. The method further includes receiving a player selection of a player selected sub-set of numbers from the set of available numbers. The method further includes selecting, using one or more processors, a first set of drawn numbers from the set of available numbers. The method further includes updating the display of the keno board to indicate the selection of the first set of drawn numbers and the player selection. The method further includes identifying, using the one or more processors, a second set of one or more matches by comparing the first set of drawn numbers and the player selected numbers. The method further includes calculating, using the one or more processors, payout based on the first set of matches and the second set of matches.

Another exemplary embodiments relates to an electronic device for playing a keno game. The electronic device includes a display configured to display the keno game to a player having a keno board with a first predetermined number of keno board spots. The electronic device further includes a user-input panel. The electronic device includes a game controller having one or more data processors and one or more storage devices storing instructions that, when executed by the one or more data processors, cause the one or more data processors to perform operations comprising: displaying a keno board having a set of available numbers and a first set of one or more matches identified between player selected numbers and drawn numbers from a previous keno game; receiving a player selection of a player selected sub-set of numbers from the set of available numbers; selecting, using one or more processors, a first set of drawn numbers from the set of available numbers, wherein number of the first set of drawn numbers is modified by number of matches in the first set of matches; updating the display of the keno board to indicate the selection of the first set of drawn numbers and the player selection; identifying a second set of one or more matches by comparing the first set of drawn numbers and the player selected numbers; and calculating payout based on the first set of matches and the second set of matches.

Yet another exemplary embodiment relates to computer readable storage medium having machine instructions stored therein, the instructions being executable by a processor to cause the processor to perform operations comprising: displaying a keno board having a set of available numbers and a first set of one or more matches identified between player selected numbers and drawn numbers from a previous keno game; receiving a player selection of a player selected sub-set of numbers from the set of available numbers; selecting, using one or more processors, a first set of drawn numbers from the set of available numbers; updating the display of the keno board to indicate the selection of the first set of drawn numbers and the player selection; identifying a second set of one or more matches by comparing the first set of drawn numbers and the player selected numbers; and calculating payout based on the first set of matches and the second set of matches.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

DETAILED DESCRIPTION

Figure 1A:
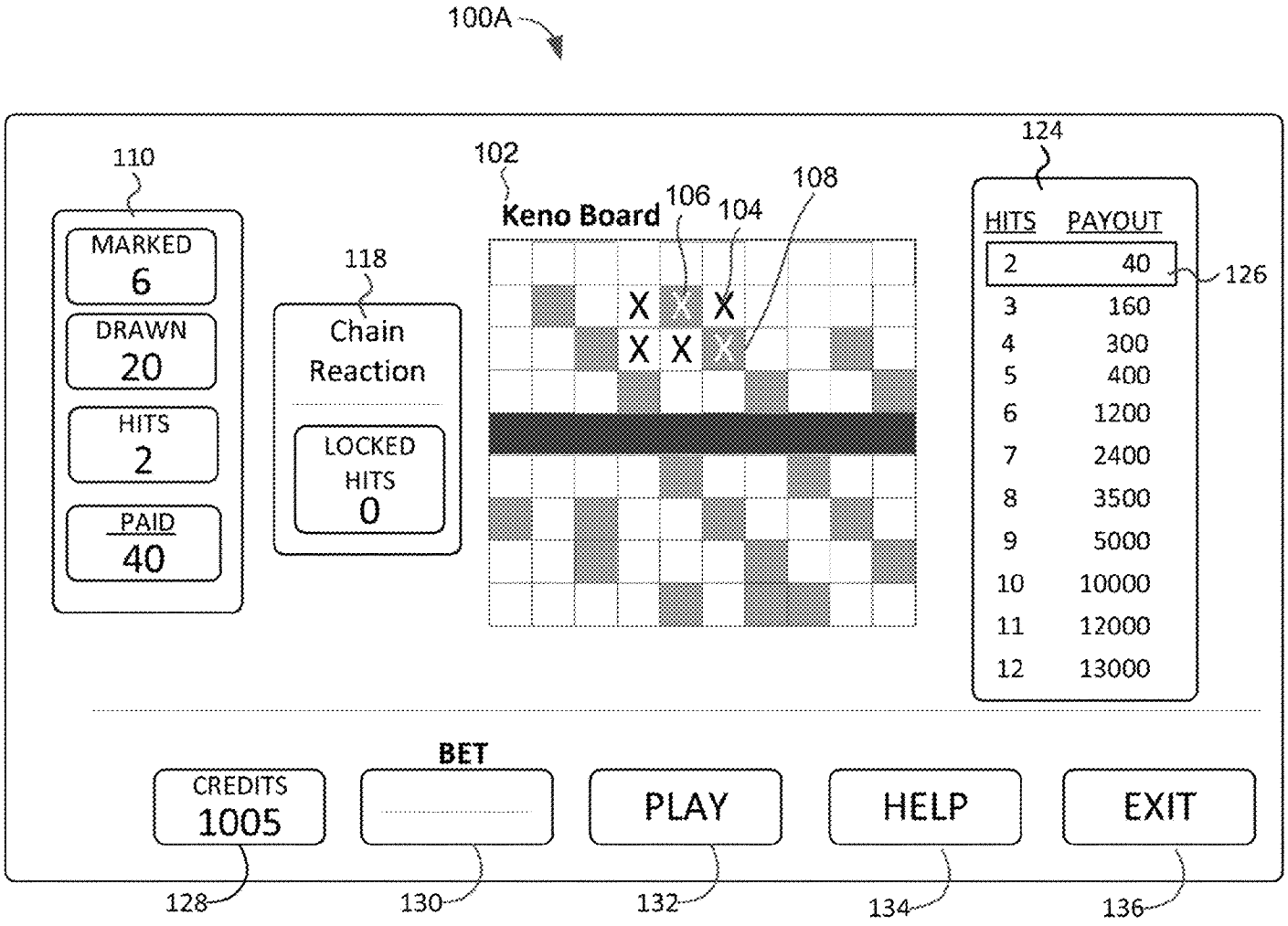
FIGS. 1A-E are illustrations of keno games allowing carrying over of hits from a previous keno game to the next keno game, in an accordance with an example implementation.

Numerous specific details may be set forth below to provide a thorough understanding of concepts underlying the described embodiments. It may be apparent, however, to one skilled in the art that the described embodiments may be practiced without some or all of these specific details. In other instances, some process steps have not been described in detail in order to avoid unnecessarily obscuring the underlying concept.

According to various embodiments disclosed herein, a keno game allowing for carrying over of hits from a keno game to subsequent keno games is provided. As used herein, hits are matches between player selected spots and drawn numbers. In the beginning of a keno game play, hits from another keno game (e.g., previous keno game or previous keno game round) may be displayed on the keno board shown on an electronic display of a gaming machine or the player's computing device. In some implementations, these hits may originate from a previous keno game played by the player. In other implementations, the hits originate from the same keno game and a bonus round is played in which the hits from the original play are carried over into the bonus round.

The carried over hits from another game may be displayed on the keno board to create an impression that they are "locked" on the keno board. In some implementations, the carried over hits may be shown using different visual indicators than the hits that are detected during the play of the current keno game. For example, the carried over hits may be shown with nails nailed into the keno board, while the hits from the current keno game may be shown with an "X". In some implementations, the background color of the keno board spots displaying the carried over hits may be of different color than the keno board spots showing the hits in the current game. In other implementations, both types of hits may be shown with the same visual indicators but with different colors of the indicators. The carried over hits may be visually emphasized to the player in any other fashion.

At the start of the keno game play, the keno board may be cleared out of draws and player selected spots from previous keno game play or previous keno game, and some or all of the hits from the previous keno game play/keno game may remain on the keno board. In one implementation, all the hits from the previous keno game are shown on the keno board of the keno game. In another implementation, a subset of hits from the previous keno game may be shown on the keno board of the keno game.

The player may select and mark spots (e.g., any number between 3 and 10 spots) on the keno board. After the player selects keno board spots, a predetermined number of numbers (i.e., twenty numbers or another number of numbers) may be randomly drawn from a set of available numbers (e.g., one through eighty). The randomly selected numbers may be shown to the player as "ball drops". The spots that are selected by the player are numbers that are a sub-set of the total set of available numbers (e.g., selection of six numbers from a set of eighty available numbers from one through eighty). The number of keno spots shown on the keno board may be any number (e.g., 80 keno spots, 100 keno spots, 150 keno spots, etc.)

The keno game may detect hits by comparing the player-marked spots and drawn balls. A payout to the player may be calculated based on both the carried over hits from another keno game and the hits detected in the current keno game. For example, if two hits are carried over from the last keno game played by the player and three hits are detected during the current keno game, then the player is entitled to a payout for five hits in accordance with one or more paytables. In this example, the three hits that are detected during the current keno game may be carried over to the next keno game and the two hits from the previous keno game are removed from the keno board.

In some embodiments, a subset of the hits from a single keno game carry over to multiple subsequent games. In these embodiments, the number of hits that are detected in a first game are carried over to each subsequent game with the number of hits carried over decreased by one for each subsequent game. For example, a first keno may have five hits detected, in which case four of these hits may be carried over to a second game. In this example, a third keno game may have three of the five original hits carry over, while two of the five original hits carry over to a fourth game, and finally one "hit" may carry over to a fifth keno game. None of the hits from the original keno game would carry over to the sixth keno game.

In one embodiment, the first picks of the next game may be used to the same effect as locking the hits. For example, if there are two hits in the current game that should carry over on spots six and ten, instead of locking those spots on the board in the next game and picking eighteen balls on the next game, the next game may "guarantee" that the first two picks on the next game are on spots six and ten.

A keno game may calculate a decay value used for determining the number of subsequent keno games that receive the same number of carried over hits from an original game. The decay value may be fixed or randomly determined from a predetermined set of numbers. In some implementations, the decay value may be determined based on a combination of factors (e.g., the player bet) associated with the keno game. For example, if a decay value is determined to be five, then the hits from a keno game may be carried over to five subsequent keno games. In this example, the original keno game may have three hits, and five subsequent keno games may have these three hits carried over and used to determine payout to the player. The keno games may be single or multi-card keno games. The decay value may be a time value, such as a number of minutes or seconds, that determine how long the same number is carried over. The time value is such cases may be predetermined or randomly determined. Different spots or numbers on the same keno board may have different decay values or be assigned different decay values.

In some implementations, carrying of hits between keno games may not be permitted. In these implementations, a bonus round may be triggered and the hits from the original keno game may be carried over to the bonus round. Multiple bonus rounds may be utilized with each bonus round receiving hits from the original keno game and/or another bonus round.

FIGS. 1A-E illustrate a chain reaction feature of keno games, which allows for hits from a previous keno game to be carried over to the current keno game. Referring now to FIG. 1A, a user interface for a keno game 100A is shown. In particular, a keno board 102 is displayed with eighty keno board spots. Although each spot in the keno board 102 is shown as a separate square, the keno spots may be shown on the keno board as numbered balls, numbered squares, or another visual representation.

The player has selected six spots on the keno board 102. For example, as shown spots 104, 106, and 108 are marked by the player as well as three other keno board spots. Twenty numbers are randomly drawn by the keno game and displayed on the keno board. As shown in FIG. 1A, the squares on the keno board that correspond to the drawn numbers are updated to be displayed in grey color. Any other visual indicators may be used to signify drawn spots.

Out of the six spots selected by the player, two spots match the drawn spots and are considered hits. In particular, spots 106 and 108 are hits. Accordingly, a payout for the two detected hits needs to be provided to the player. A paytable 124 specifies the payout due to the player for the various possible numbers of hits. For example, for the two detected hits, the payout due to the player is 40 credits. If the player received nine hits, the player would be awarded 5,000 points in accordance with the payout table 124. Although, the paytable 124 provides payout for the number of hits between 2 and 12, any other numbers of hits can be included in the paytable.

In some implementations, multiple paytables may be provided for determining the payout to the player. In these implementations, one paytable may be provided for determining payout based on the total number of hits carried over from a previous keno game, while a second paytable may be provided for determining payout based on the total number of hits from the current keno game. The total payout to the player would be the sum of the two payout calculations.

Various keno game information can be provided to the player. A game summary section 110 displays that 6 spots were marked by the player on the keno board, 20 spots were drawn, 2 hits were detected, and that, as a result, 40 credits are paid to the player. A chain reaction section displays the number of locked hits from a previous game. If the chain reaction feature was triggered, the chain reaction section would display the number of hits from the previous game that would be shown as "locked" hits in the current game. In the keno game shown in FIG. 1A, the chain reaction section displays that 0 hits are carried over from the previous game. This may be due to the last game not having any hits. Alternatively, the zero number of carried over hits maybe explained by a chain reaction feature ending during the previous game.

Although the keno board spots are not numbered in FIGS. 1A-E, they can be numbered with unique numbers from one to eighty. The keno board spots can be shown in any other manner (e.g., as balls instead of squares, or as numbers without any shapes around them) including the use of unique symbols instead of numbers.

A bottom section of the keno game displays a total number of credits earned by the player. The player can also enter the bet in a field 130 for playing the next keno game. Buttons 132, 134, and 136 are provided to enable the player to play, get help, or exit the keno game respectively.

Figure 1B:
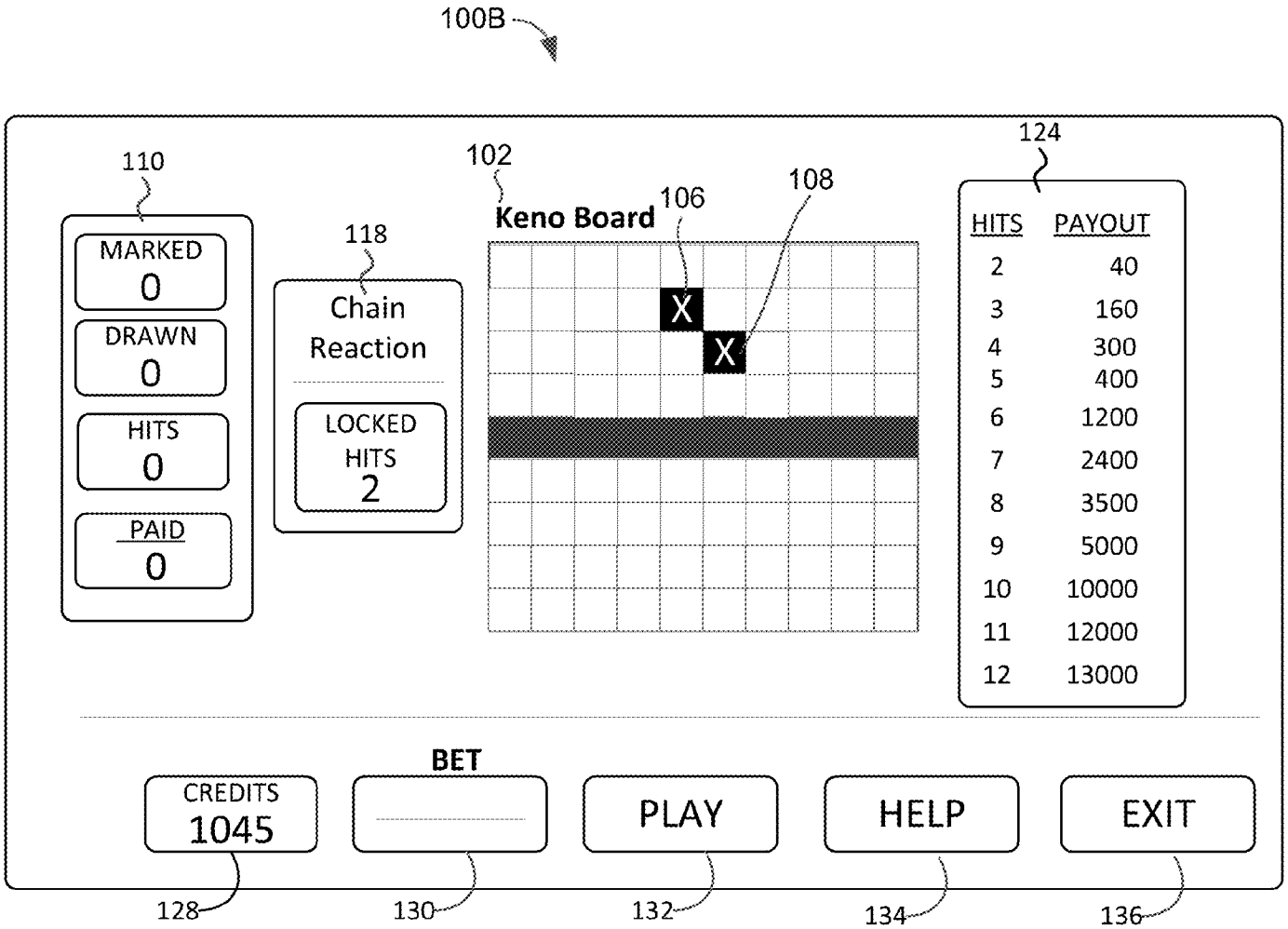

FIG. 1B illustrates a keno game 100B that is played by the player after the play of the keno game 100A is completed. At the beginning of the keno game 100B, the keno board 102 is cleared out except for the keno spots 106 and 108 that are the hits from the previous keno game 100A. As shown, the keno spots 106 and 108 are displayed as black squares with white "X" indicator inside to indicate that these hits from the previous keno game are "locked" on the keno board 102 of the current keno game 100B. The "locked" hits from the previous keno game can be shown using any other visualization techniques and indicators. For example, the "locking" of the hits from the previous game can be shown as an animation of hammering of nails into the keno board spots that corresponds to hits from the previous game.

Figure 1C:
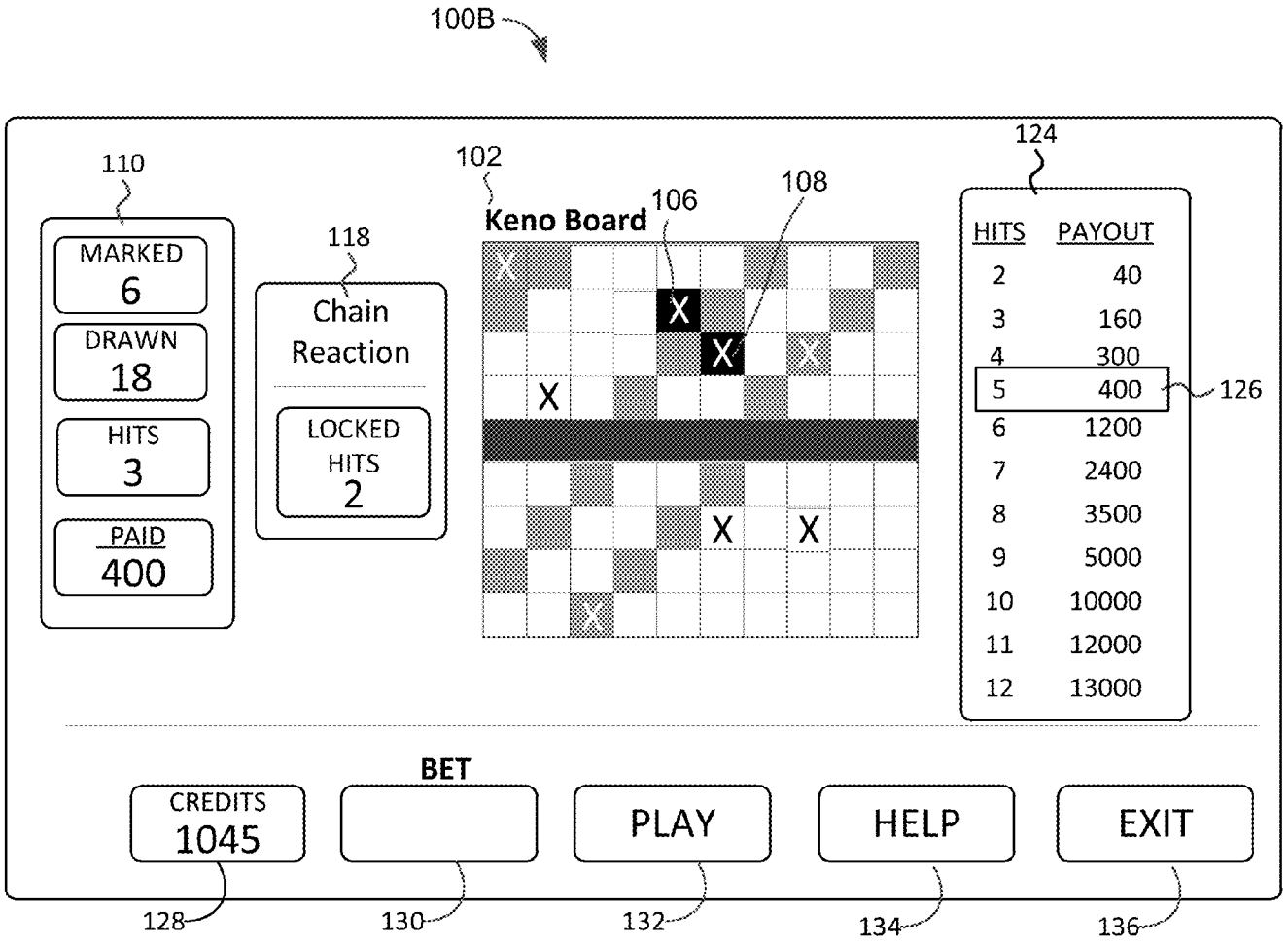

Now referring to FIG. 1C, the keno board 102 of the keno game 100B displays two hits from the previous keno game 100A. Specifically, keno board spots 106 and 108 are displayed as hits from the previous keno game. The keno board spots 106 and 108 are visually emphasized to the user with black background color in the corresponding keno board squares. Any other visual indicators such as colors, animation, etc. can be used to identify the hits from the previous keno game. The hits from the previous game can be shown in such a way as to create an impression that they are "locked" on the keno board.

The player selection of 6 keno board spots and 18 drawn keno board spots in the keno game 100B are also shown on the keno board 102. The total of drawn keno board spots is modified by the number of hits carried over to the current game from the previous keno game. In this case, because two hits are carried over from the previous keno game, the number of drawn spots is modified by two. As a result, eighteen keno board spots are drawn instead of twenty during the keno game 100B (i.e., twenty spots minus two spots results in eighteen drawn keno board spots). In some embodiments, regardless of the number of hits carried over from the previous keno game, the number of drawn spots in the current game does not change. In these embodiments, twenty keno board spots would be drawn.

In some implementations, instead of modifying the total number of drawn keno board spots, the total number of spots that the player is allowed to mark in the current keno game may be modified by the number of hits carried over to the current game from the previous keno game. In these implementations, because two hits are carried over from the previous keno game, the number of spots that the player may select is modified by two. As a result, the player is allowed to select four spots on the keno board during the keno game 100B instead of six keno board spots.

Out of the 6 player selected keno board spots, three spots match the drawn numbers. As a result, a total of five keno board spots selected by the player are hits (i.e., three player selected spots from the 100 B keno game and two player selected spot from the previous keno game 100A). The payout due to the player is calculated based on the total five hits including both hits from the current and the previous keno games. Thus, in accordance with the payout table 124, a total of 400 credits are due to the player.

The keno game summary section 110 of the keno game 100B displays that 6 spots were marked by the player on the keno board, 18 spots were drawn, and that 3 new hits were detected. Furthermore, the chain reaction section 118 indicates that three hits are locked from the previous keno game. As a result, the keno game summary section 110 displays that 400 credits are paid to the player in the keno game 100B. The total credits field 128 is updated to show the payout earned by the player in the previous keno game 100A. The total number of credits field 128 may be updated to reflect the payout of 400 credits earned by the player in the current keno game 100B.

Figure 1D:
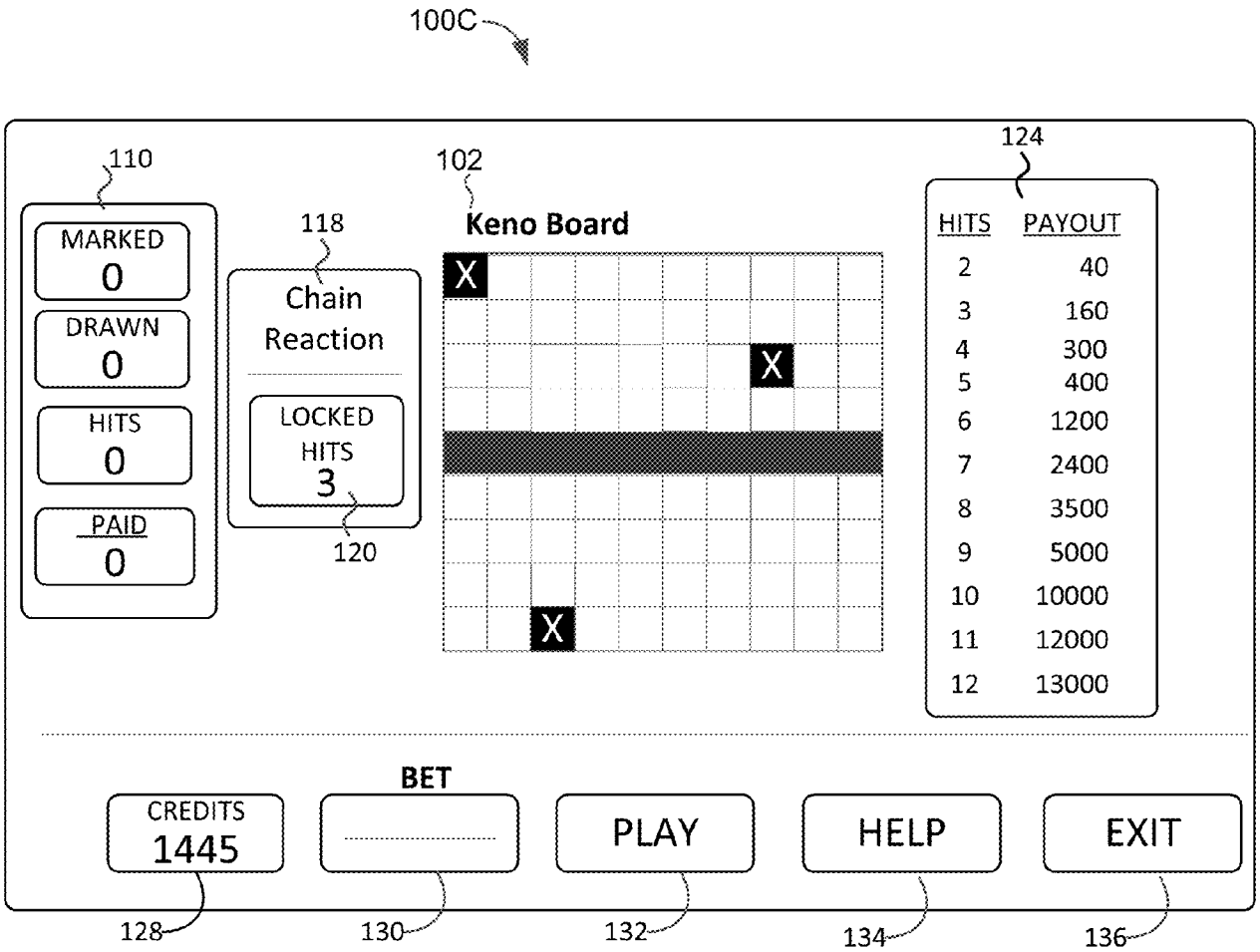

Now referring to FIG. 1D, a keno game 100C is shown. The keno board 102 is cleared except for the three keno spots that are the hits from the previous keno game 100B. As shown, the keno spots are displayed as black squares with white "X" indicator inside to indicate that these hits from the previous keno game are "locked" on the keno board 102 of the current keno game. The "locked" hits from the previous game can be shown using any other visualization techniques and indicators. The chain reaction section 118 displays that three hits are "locked" from the previous keno game 100B. The total number of credits field 128 displays the updated total number of credits of 1445 earned by the player including the 400 credits earned in the previous keno game 100B.

Figure 1E:
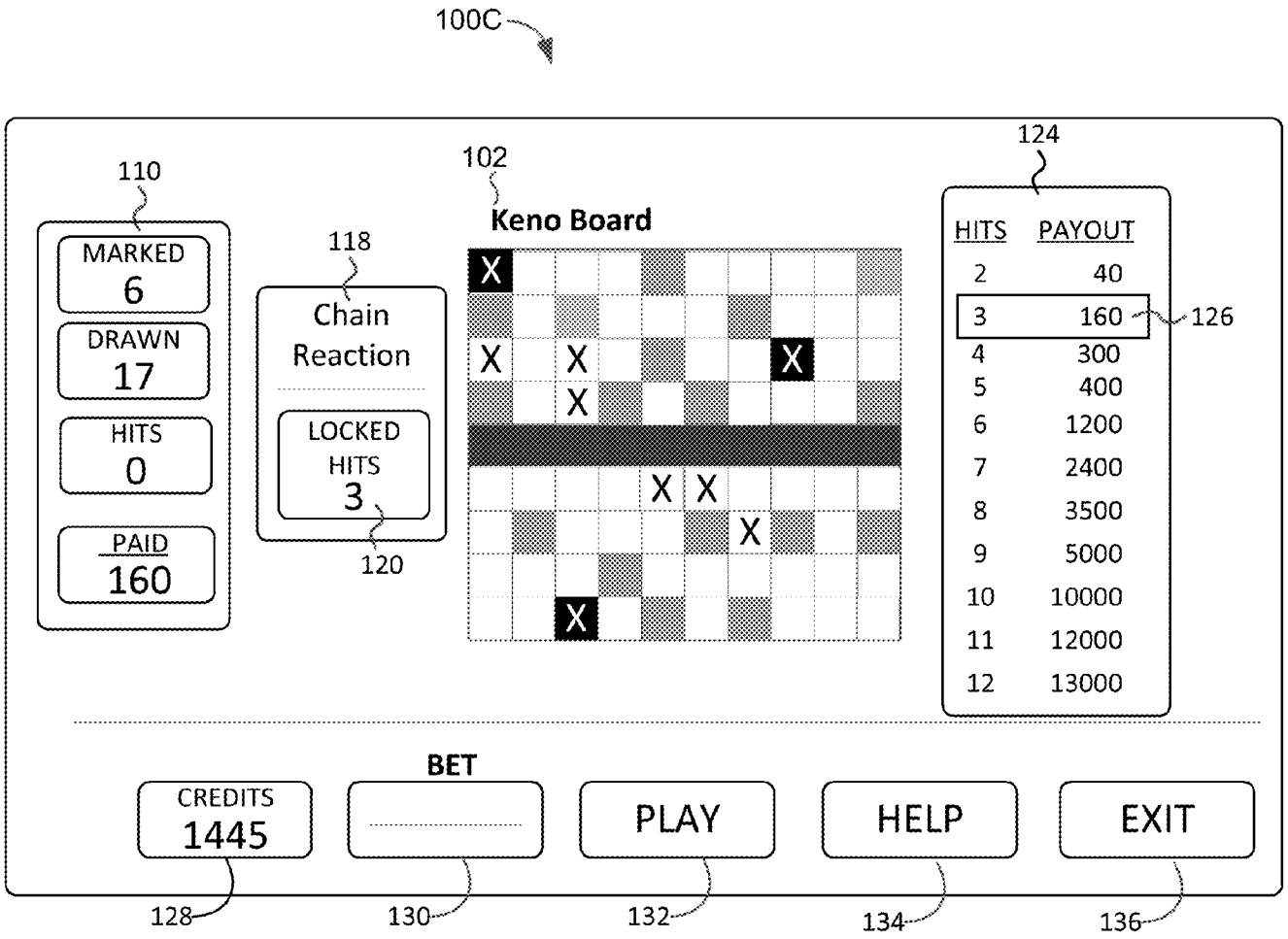

FIG. 1E illustrates a new keno game 100C. The keno board 102C displays the three hits carried over to this keno game from the previous keno game 102B. The keno board hits from the previous keno game 100B are visually emphasized to the user on the keno board 102 with black background color in the corresponding keno board squares. Any other visual indicators such as colors, animation, etc. can be used to identify the hits from the previous keno game. The hits from the previous game can be shown in such a way as to create an impression that they are "locked" on the keno board.

As shown, the player selected six keno board spots and eighteen drawn keno board spots in the keno game 100C are also shown on the keno board 102. The total of drawn keno board spots is modified by the number of hits carried over to the current game from the previous keno game. In this case, because three hits are carried over the previous keno game, the number of drawn spots is modified by three. As a result, seventeen keno board spots are drawn instead of twenty during the keno game 100C (i.e., twenty spots minus three spots results in seventeen drawn keno board spots). In some embodiments, the number of drawn spots in the current game may depend on the total number of carried over keno board spots from previous games. In these embodiments, in the previous keno games, two hits were carried over from keno game 100A to 100B and three "hits were carried over from the keno game 100B to the keno game 100C to a total five hits. The number of drawn spots may be then modified by the total number of carried over hits from the previous games, which in this case would be a total of five hits. Thus, the number of drawn spots would be fifteen (i.e., twenty spots minus five spots).

As shown, none of the player selected hits in the keno game 100C match the drawn spots. Thus, the player is entitled to 160 credits for the three hits that are carried over from the previous keno game 100B. Because none of the newly selected spots by the player match any of the drawn fifteen keno board spots, the chain reaction feature may be disabled. In other words, no hits would be carried over from the current keno game 100C to the next keno game. If in the next keno game, hits are identified, then those hits may be carried over to the subsequent keno game.

The keno game summary section 110 of the keno game 100C displays that 6 spots were marked by the player on the keno board, 17 spots were drawn, and that no new hits were detected. Furthermore, the chain reaction section 118 indicates that three hits are locked from the previous keno game. 100B As a result, the keno game summary section 110 displays that 160 credits are paid to the player in the keno game 100C. The total credits field 128 is updated to show the payout earned by the player in the previous keno game 100B. The total number of credits field 128 may be updated to reflect the payout of 400 credits earned by the player in the current keno game 100C.

In some embodiments, when the chain reaction feature is activated during one keno game, and the hits identified during this keno game are carried over to one or more subsequent keno games. In these embodiments, not all the hits from the current game may be carried over to the next game. For each subsequent game, the number of hits that are identified in the keno game during which the chain reaction feature is activated may be decreased by one. For example, if during the first keno game four spots are hits, three of these four hits are carried over to a second keno game. In this example, two of these three hits shown in the second keno game are carried over into a third keno game, and in turn one of the two "locked hits" from the third game are carried over into a fourth keno game. The chain reaction feature may be deactivated during the fourth keno game. This concept of carrying over multiple hits from an original keno game into subsequent keno games is illustrated in FIGS. 2A-G.

Figure 2A:
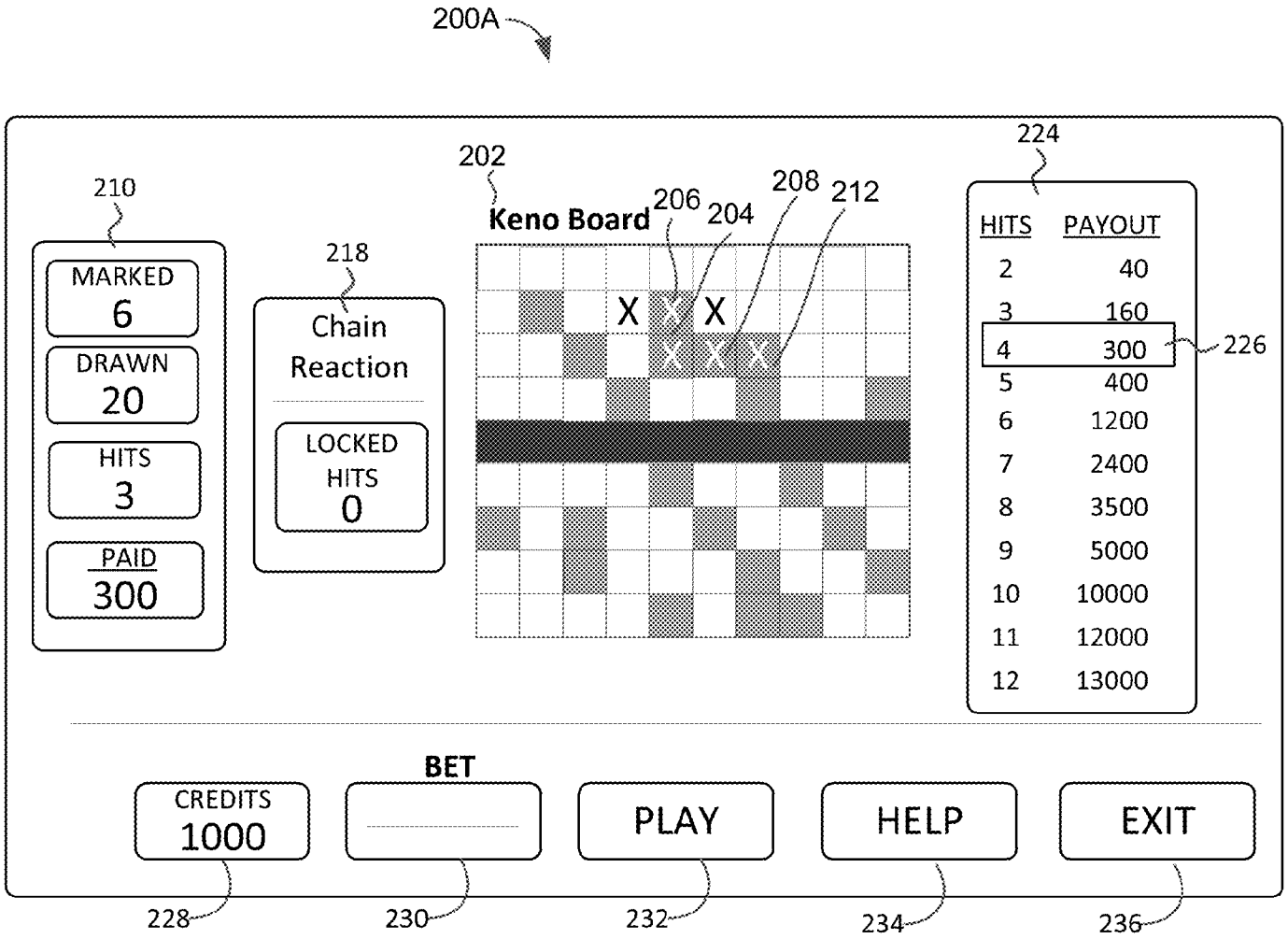
FIGS. 2A-G are illustrations of keno games allowing carrying over of hits from an original keno game to multiple subsequent games, in an accordance with an example implementation.

Referring now to FIG. 2A, a keno game 200A is illustrated. A keno board 202 displays six player selected spots along with twenty randomly drawn spots. No hits were carried over from the previous keno game into the keno game 200A. As a result, the chain reaction section 218 states that zero hits are locked.

Out of the six spots selected by the player, four keno board spots match the drawn spots and are considered hits. In particular, spots 204, 206, 208, and 212 are hits. Accordingly, a payout for the four detected hits needs to be provided to the player. A paytable 224 dictates that the player earned 30 credits for the three detected hits.

Figure 2B:
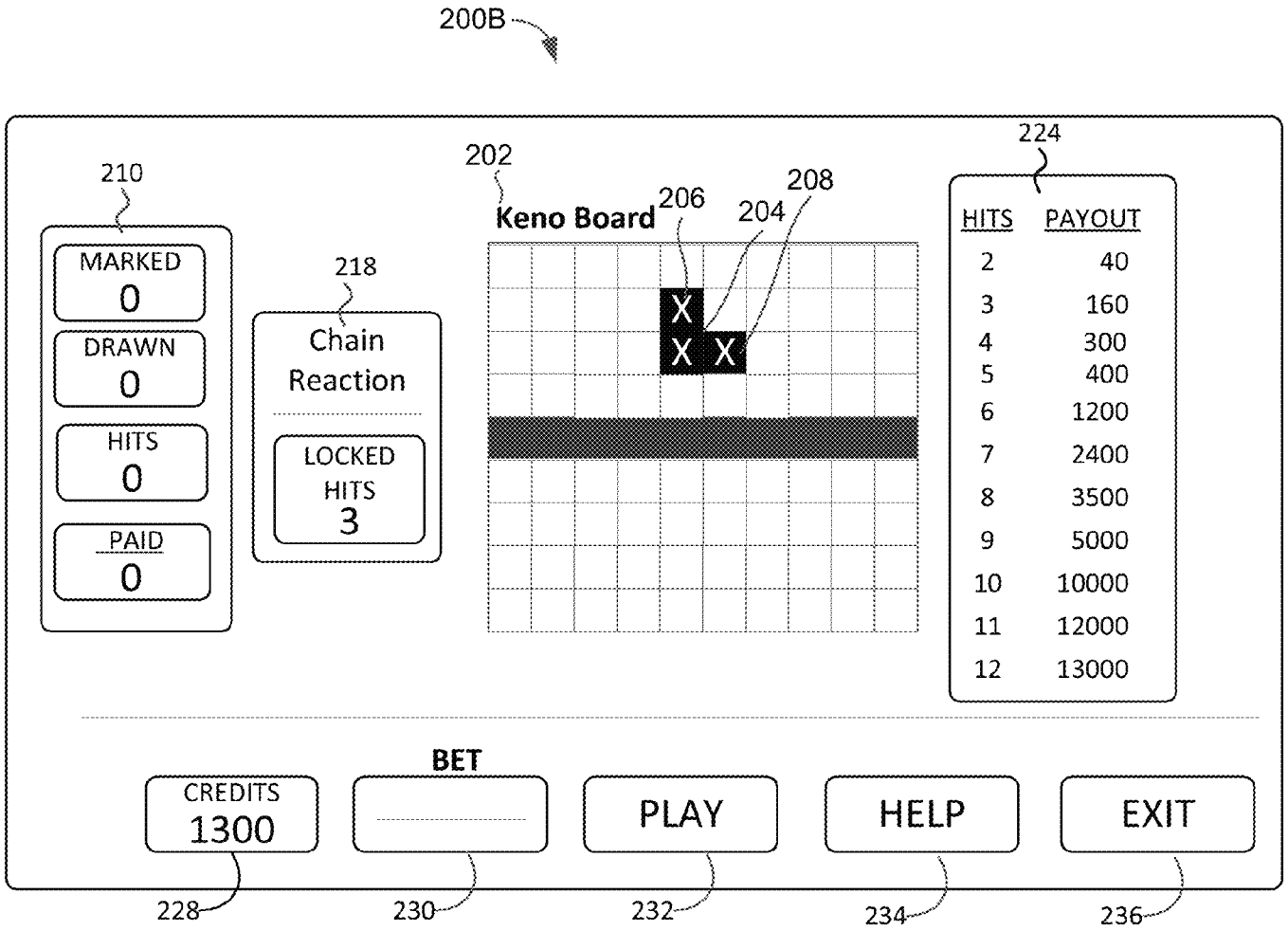

FIG. 2B further illustrates beginning of a keno game 200B during which the keno board 202 is cleared out. Three out of the four hits from the keno game 200A remain on the keno board 202. The system may determine randomly or pseudo-randomly or a mechanism allowing the player to select carry-over spots to determine which of the four hits from the keno game 200A would not be shown during the keno game 200B. As shown, hits 204, 206, and 208 remain on the keno board 202 and are visually emphasized to the user, while the keno board spot 212 is not marked as a "hit" from the previous keno game 200A on the keno board 202 of the keno game 200B.

Figure 2C:
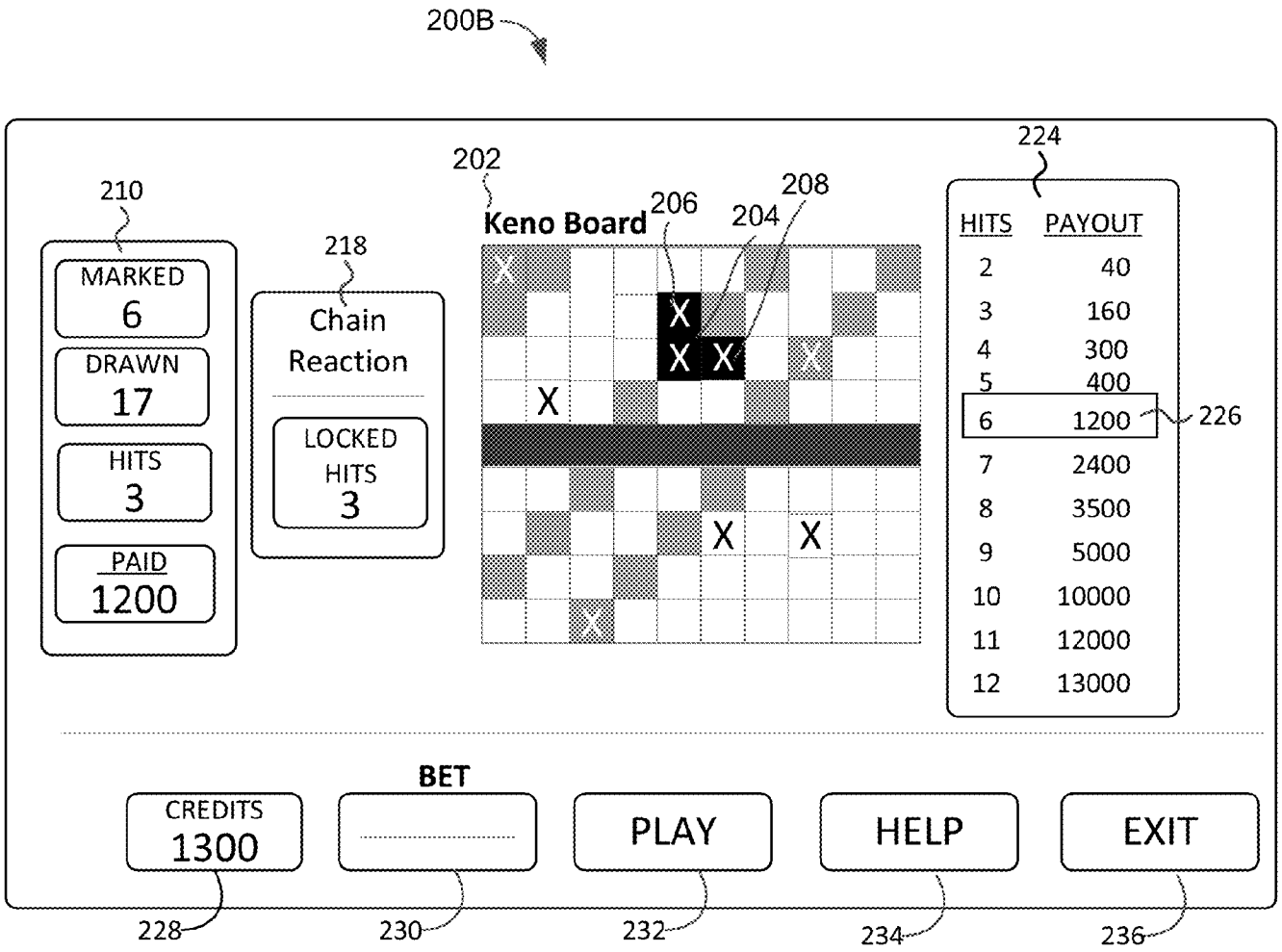

Referring to FIG. 2C, player selections and drawn spots are shown on the keno board 202. The number of drawn spots is modified by the number of hits carried over into the keno game 200B from the previous keno game 200A. In particular, because three hits are carried over from the previous keno game 200A, the number of drawn spots equals twenty minus the number of hits carried over from keno game 200A. As a result, seventeen keno board spots are drawn instead of twenty.

Three hits are detected from the seventeen drawn spots and the six player marked spots. A total of the three hits are detected and the three hits carried over from the previous keno game 200A are used to calculate the payout to the player. Thus, the player received a payout of 1,200 credits for the total of six hits.

The keno game summary section 210 of the keno game 200B displays that 6 spots were marked by the player on the keno board, 17 spots were drawn, and that 3 new hits were detected. Furthermore, the chain reaction section 218 indicates that three hits are locked from the previous keno game. As a result, the keno game summary section 210 displays that 1,200 credits are paid to the player in the keno game 200B. The total credits field 228 is updated to show the payout earned by the player in the previous keno game 200A. The total number of credits field 228 may be updated to reflect the payout of 1,200 credits earned by the player in the current keno game 200B to a total of 2,500 credits.

Figure 2D:
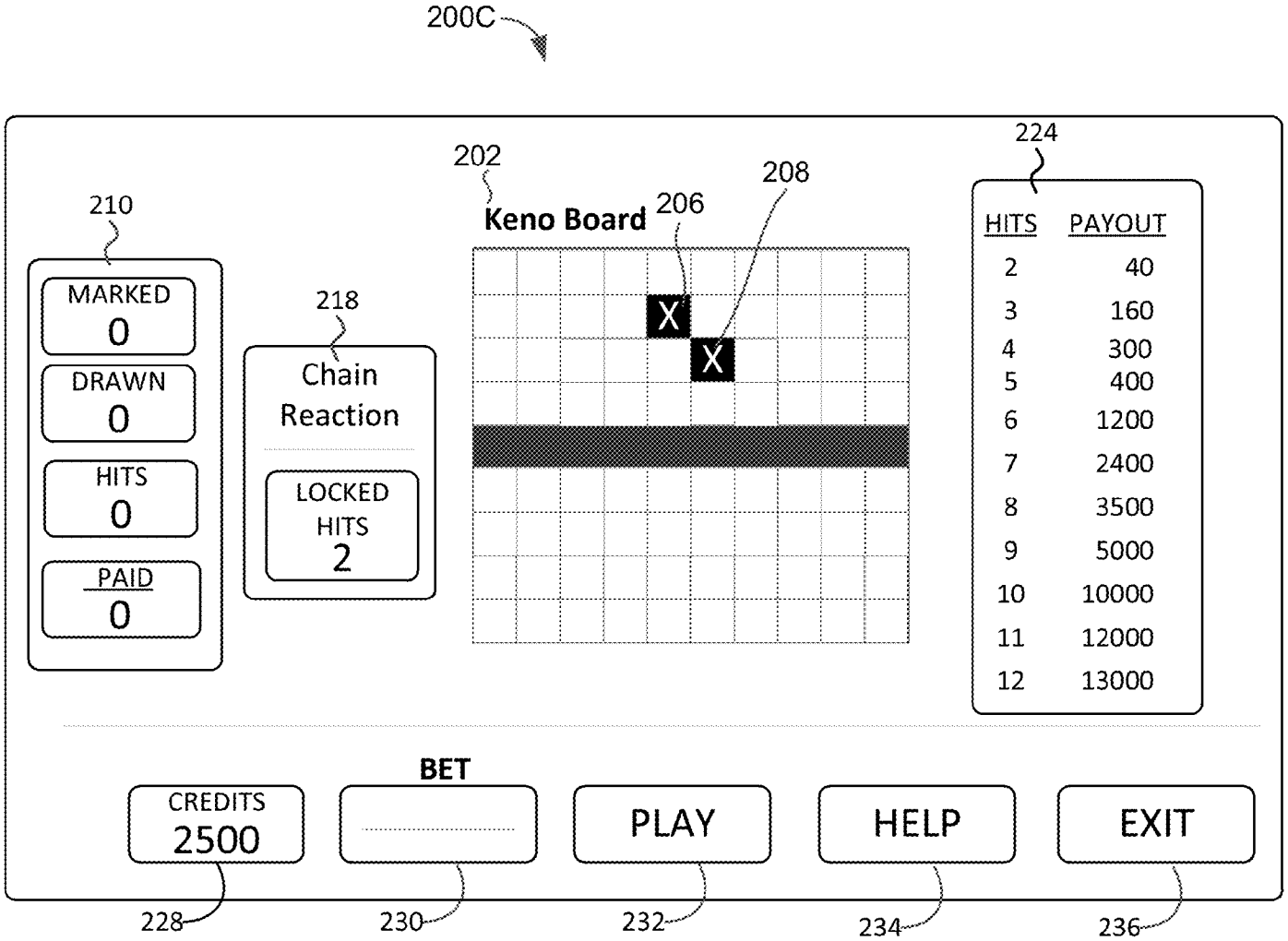

Now referring to FIG. 2D, a subsequent keno game 200C is shown. The keno game 200C may be the next keno game played by the player after the keno game 200B. The keno board 202 is cleared except for some of the keno spots that are locked hits from the previous keno game 200B. In particular, two of the three locked hits from the keno game 200B are shown during the keno game 200C. Thus, out of the four hits from the keno game 200A, two of those hits are carried over to the keno game 200C. The one locked "hit" that was shown in the keno game 200B but is not shown as a locked "hit" in the keno game 200C may be determined randomly.

The chain reaction section 218 displays that two hits are "locked" from the previous keno game 200B. The total number of credits field 128 displays the updated total number of credits of 2,500 earned by the player including the 1,200 credits earned in the previous keno game 200B.

Figure 2E:
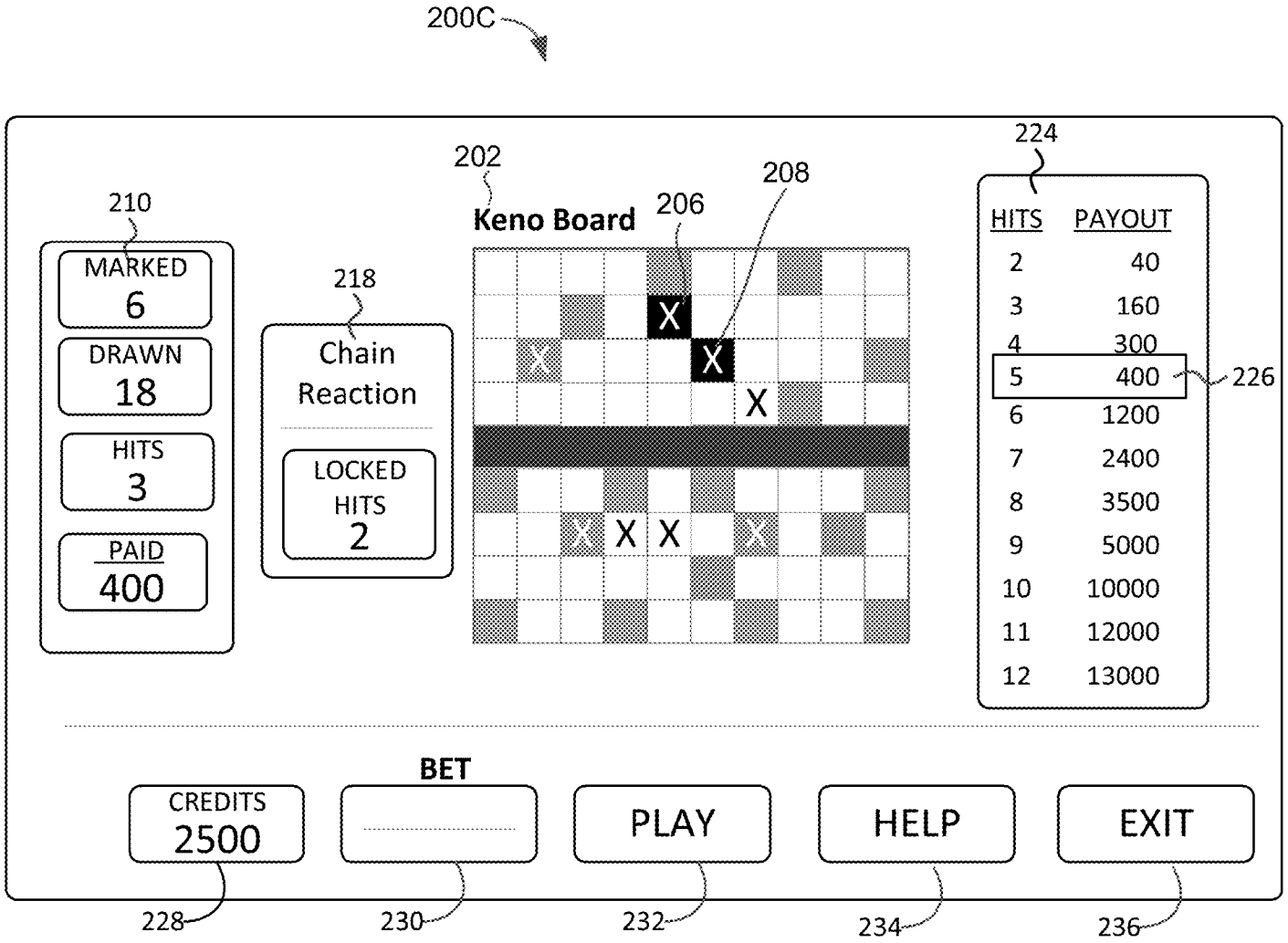

Six new player selected spots and eighteen randomly drawn spots are shown on the keno board 202 of the keno game 100C as shown in FIG. 2E. The keno board 202C displays the two hits carried over to this keno game from the previous keno game 202B. The total of drawn keno board spots is modified by the number of hits carried over to the current game from the previous keno game. In this case, because two hits are carried over the previous keno game, the number of drawn spots is modified by two. As a result, eighteen keno board spots are drawn instead of twenty during the keno game 200C (i.e., twenty spots minus two spots results in eighteen drawn keno board spots). In some embodiments, the number of drawn spots in the current game may depend on the total number of carried over keno board hits from the original keno game during which the chain reaction feature was activated. In these embodiments, the original keno game 200A had four hits, and as a result, in which subsequent keno game to which the hits from the keno game 200A are carried over, the number of drawn spots equals sixteen (i.e., twenty spots minus four hits from the original keno game 200A).

As shown, three of the player selected spots in the keno game 200C match the drawn spots. Thus, the player is entitled to 400 credits for the two hits that are carried over from the previous keno game 200B and for the three hits identified in the current keno game 200C.

The keno game summary section 210 of the keno game 200C displays that 6 spots were marked by the player on the keno board, 18 spots were drawn, and that three new hits were detected. Furthermore, the chain reaction section 118 indicates that two hits are locked from the previous keno game 200B. As a result, the keno game summary section 210 displays that 1045 credits are paid to the player in the keno game 200C. The total credits field 228 is updated to show the payout earned by the player in the previous keno game 200B. The total number of credits field 128 may be updated to reflect the payout of 400 credits earned by the player in the current keno game 200C.

Figure 2F:
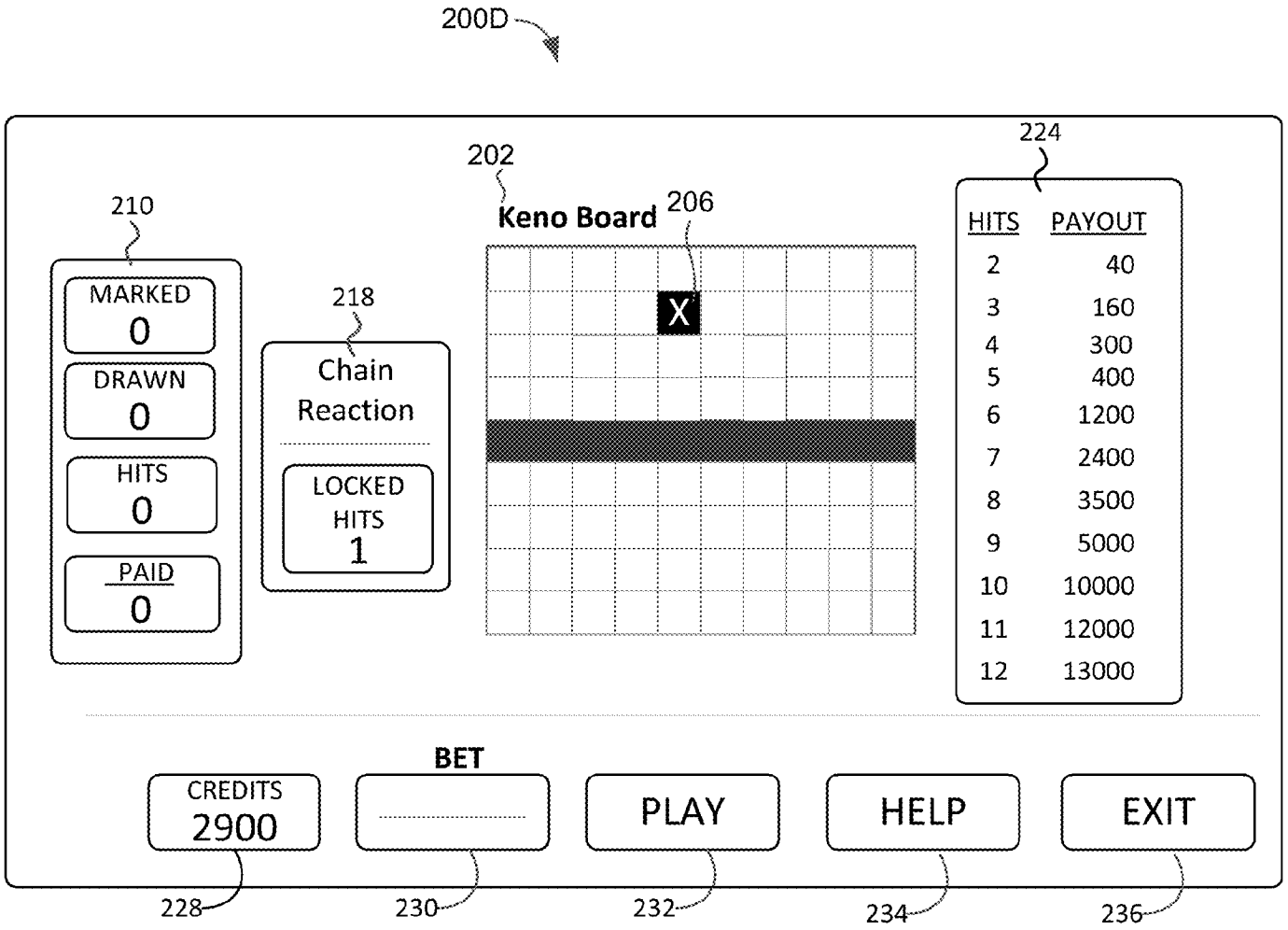

FIG. 2F illustrates a subsequent keno game 200D after the keno game 200C. As shown, one of the two locked hits from the keno game 200C are carried over to the keno game 200D. In other words, one of the four hits from the original keno game 200A are carried over to the keno game 200D. As shown, none of the hits that were identified during the keno game 200C are carried over to the keno game 200D.

Figure 2G:
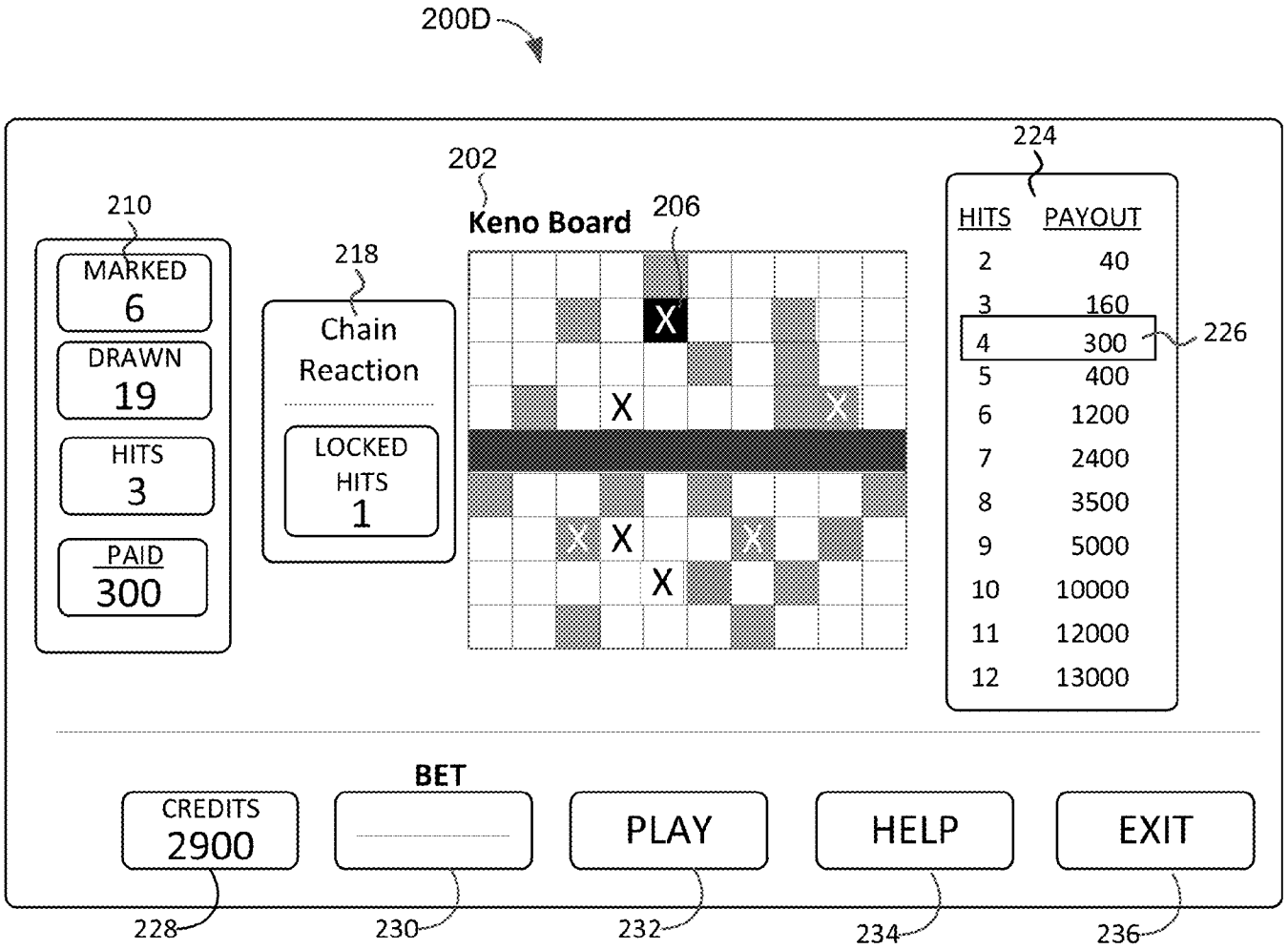

Six new player selected spots and eighteen randomly drawn spots are shown on the keno board 202 of the keno game 100D as shown in FIG. 2G. The keno board 202 displays the one "hit" carried over to this keno game. The total of drawn keno board spots is modified by the number of hits carried over to the current game from the previous keno game. In this case, because one "hit" is carried over from the previous keno game, the number of drawn spots is modified by one. As a result, nineteen keno board spots are drawn instead of twenty during the keno game 200D (i.e., twenty spots minus one spot results in nineteen drawn keno board spots). The drawn number of spots may be modified in another fashion using the number of hits carried over from another keno game. In one implementation, a multiplier may be applied to the number of hits carried over from another game and the result is subtracted from the predetermined number of drawn spots that are typically drawn in a keno game (e.g., 2 hits carried over from another game multiplied by a multiplier having value of "2", and the result of the multiplication is subtracted from 20 which results in 16 drawn spots).

The keno game summary section 210 of the keno game 200D displays that 6 spots were marked by the player on the keno board, 19 spots were drawn, and that three new hits were detected. Furthermore, the chain reaction section 218 indicates that one "hit" is locked from the previous keno game 200C. As a result, the keno game summary section 210 displays that 300 credits are paid to the player in the keno game 200D. The total credits field 228 is updated to show the payout earned by the player in the previous keno game 200C. The total number of credits field 128 may be updated to reflect the payout of 300 credits earned by the player in the current keno game 200D.

Because the number of hits carried over from the previous keno game is one, the chain reaction feature is deactivated with respect to the hits that are carried from the keno game 200A. Thus, a keno game that is subsequent to the keno game 200D will not have any of the hits carried over from the keno game 200A. In some embodiments, the chain reaction feature may be activated again with respect to the newly identified hits during the keno game 200D. In these embodiments, the all or some of the hits identified during the keno game 200D may be carried over to multiple subsequent keno games.

FIGS. 3A-E illustrate a chain reaction feature having a decay value component. In some embodiments, a decay value may be utilized to identify the number of keno games into which the hits from the current keno game may be carried over. For example, if three hits are identified and the decay value has a value of two, then all the three hits are carried over into the next two keno games. The decay value may be a time value, such as a number of minutes or seconds, that determine how long the same number is carried over. The time value is such cases may be predetermined or randomly determined. Different spots or numbers on the same keno board may have different decay values or be assigned different decay values.

Figure 3A:
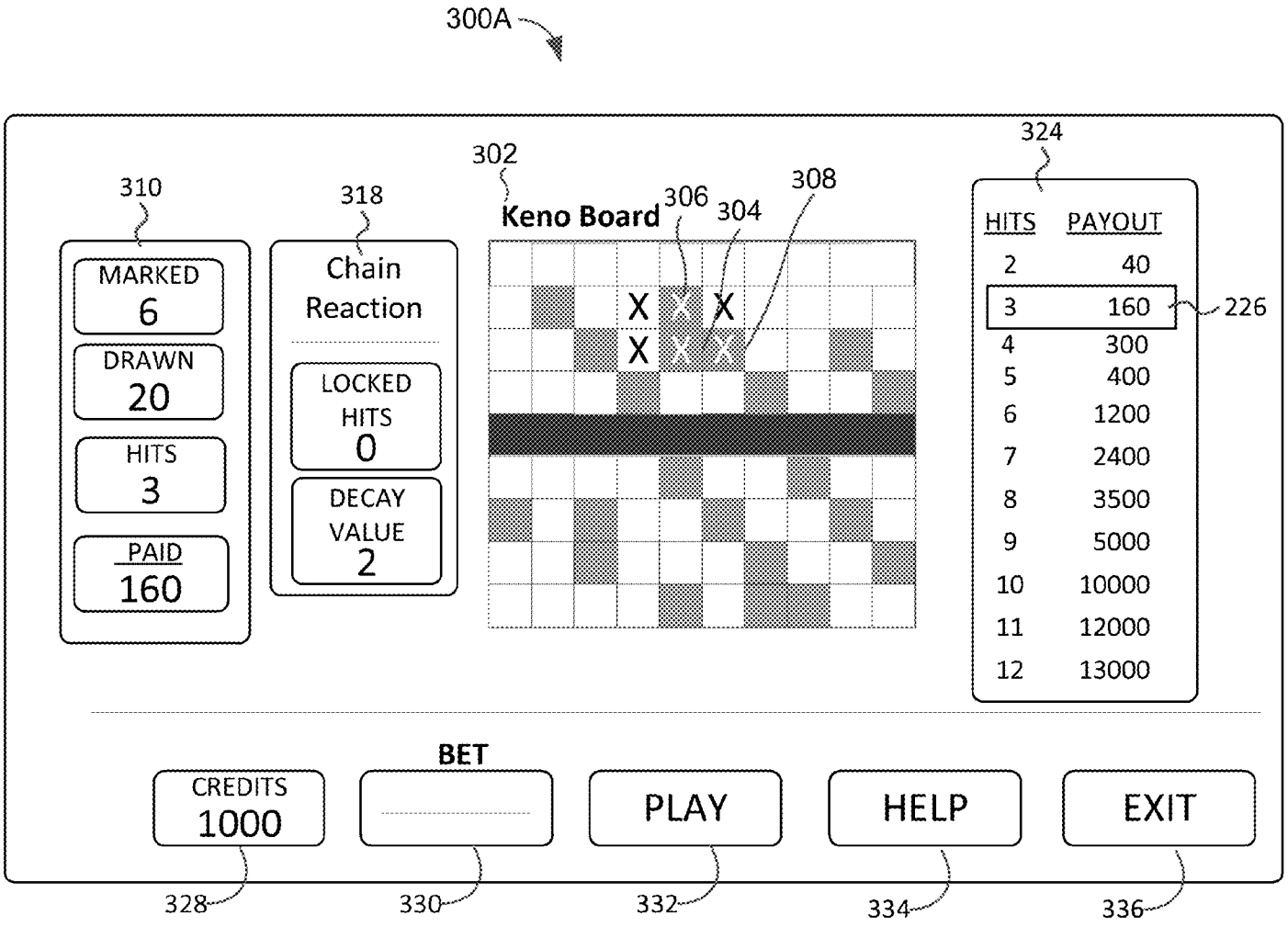
FIGS. 3A-E are illustrations of keno games allowing carrying over of hits from an original keno game to multiple subsequent games in accordance with a decay value, in an accordance with an example implementation.

FIG. 3A illustrates a keno game 300A. A keno board 302 of the keno game 300A displays six player selected spots along with twenty randomly drawn spots. No hits were carried over from the previous keno game into the keno game 300A as indicated by a chain reaction section 318. Three keno board spots selected by the player match the drawn spots. In particular, spots 304, 306 and 308 are identified hits. Accordingly, a payout of 300 credits is due to the player in accordance with the paytable 324.

The chain reaction section 318 shows that the decay value is two for the keno game 300A. This means that all or some of the hits that are detected during the keno game 300A are carried over to the number of subsequent keno games equal the decay value. Thus, the three hits detected during the keno game 300A are carried over to the two subsequent keno games. In some embodiments, a multiple of the hits detected in the keno game 300A are carried over to multiple subsequent keno games. In other embodiments, the number of hits carried over to each subsequent keno game is decreased by one for each subsequent keno game.

Figure 3B:
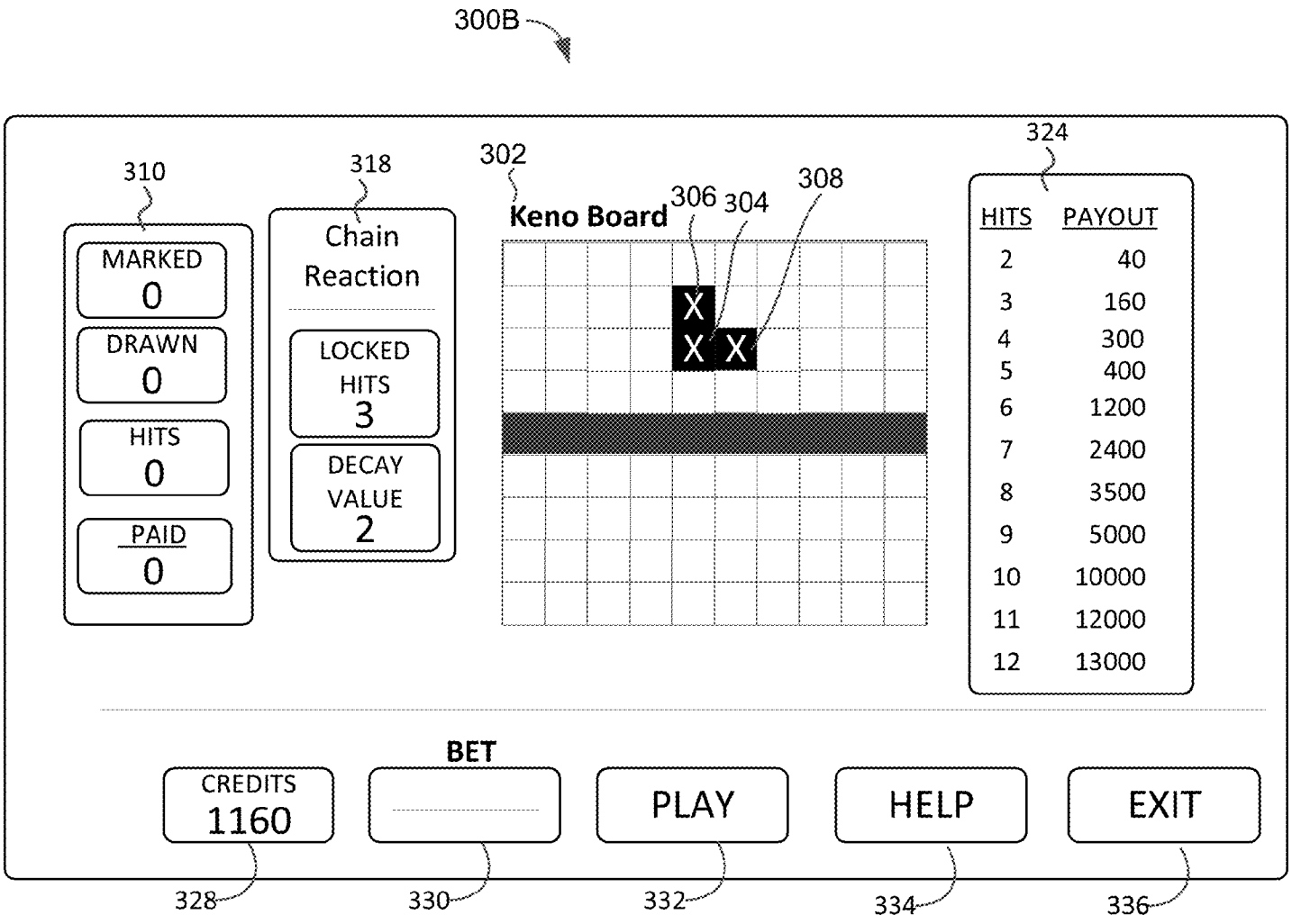
Figure 3C:
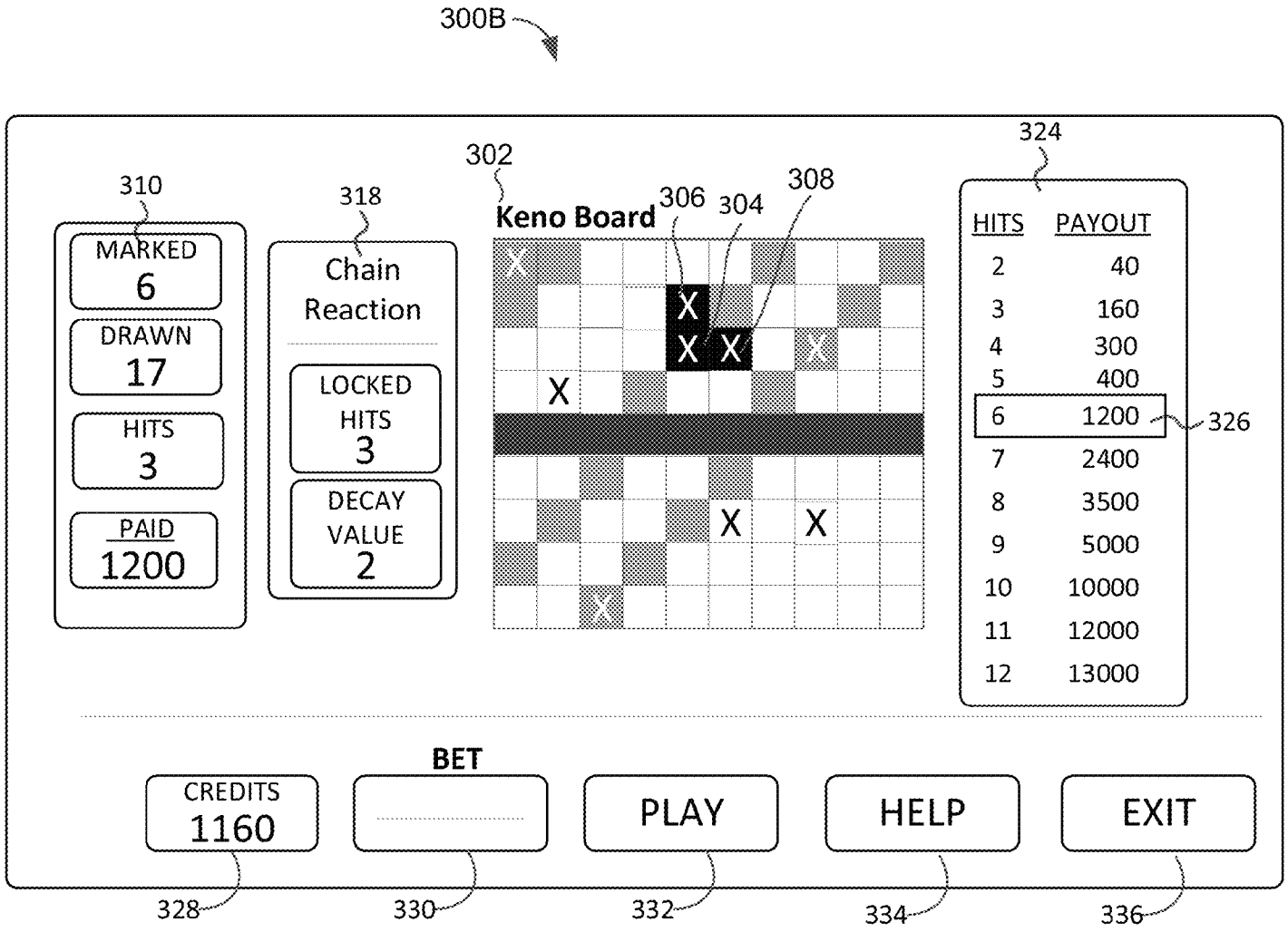

As illustrated in FIG. 3B, the three hits from the keno game 300A are carried over to the keno game 300B. The keno board 302 shows only the three hits from the previous keno game. Referring to FIG. 3C, player selections and drawn spots for the keno game 300B are shown on the keno board 302. The number of drawn spots is modified by the number of hits carried over into the keno game 300B from the previous keno game 300A. In particular, because three hits are carried over from the previous keno game 300A, the number of drawn spots equals twenty minus the number of hits carried over from keno game 300A. As a result, seventeen keno board spots are randomly drawn instead of twenty.

Three new hits are detected from the seventeen drawn spots and the six player marked spots. A total of the three hits detected and the three hits carried over from the previous keno game 300A are used to calculate the payout to the player. Thus, the player received a payout of 1,200 credits for the total of six hits. The keno game summary section 310 of the keno game 300B displays that 6 spots were marked by the player on the keno board, 17 spots were drawn, and that 3 new hits were detected. Furthermore, the chain reaction section 318 indicates that three hits are locked from the previous keno game, and that the decay value is 2. As a result, the keno game summary section 310 displays that 1,200 credits are paid to the player in the keno game 300B. The total credits field 328 is updated to show the payout earned by the player in the previous keno game 300A. The total number of credits field 328 may be updated to reflect the payout of 1,200 credits earned by the player in the current keno game 300B.

Figure 3D:
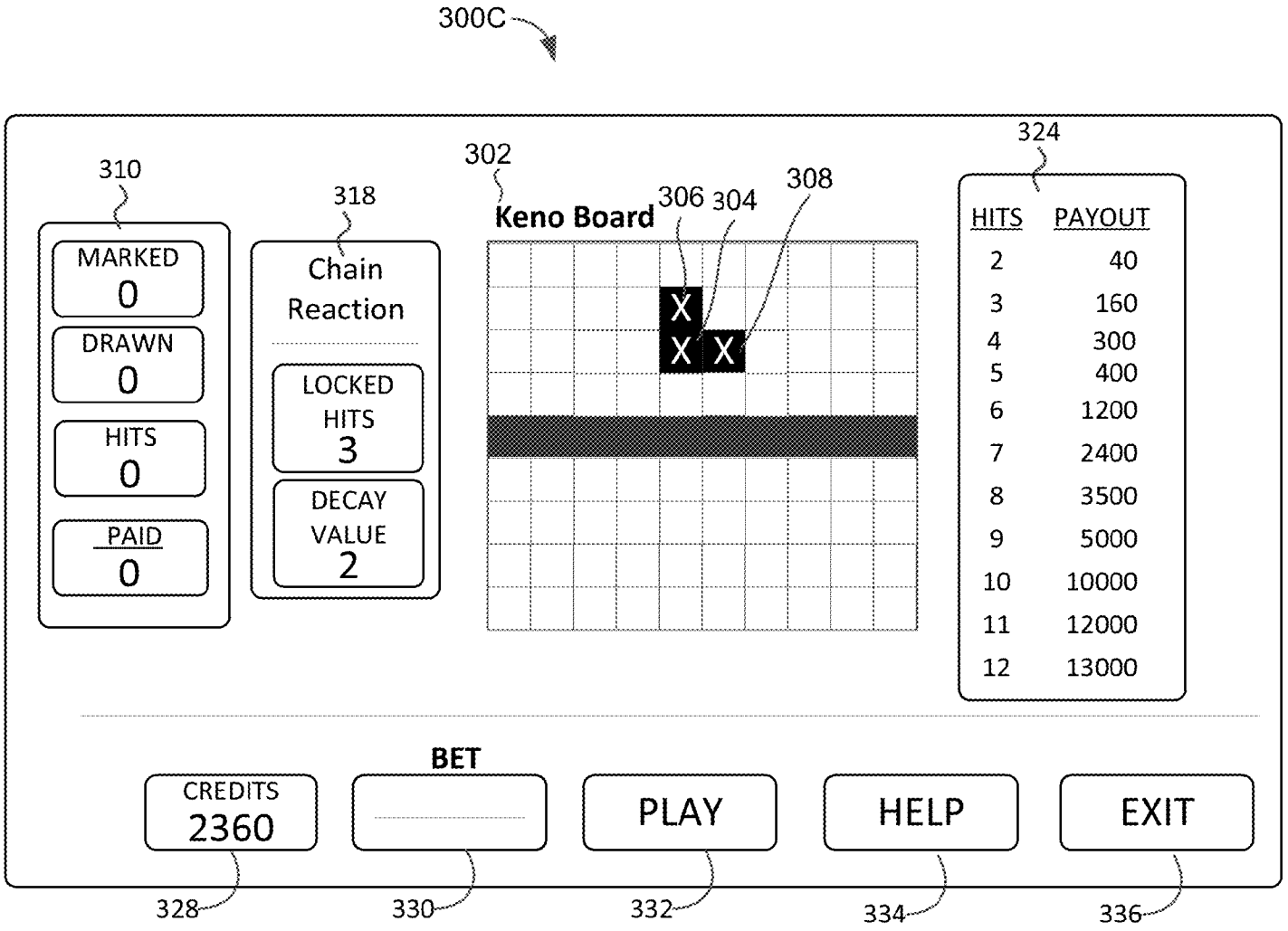

Now referring to FIG. 3D, a subsequent keno game 300C is shown. The keno board 302 is now cleared except for all keno spots that are locked hits from the previous keno game 300B. Thus, all three hits from the keno game 300A are carried over to the keno game 300C. The chain reaction section 318 displays that three hits are "locked" from the previous keno game 300B. The total number of credits field 228 displays the updated total number of credits of 2,360 earned by the player including the 1,200 credits earned in the previous keno game 300B.

Figure 3E:
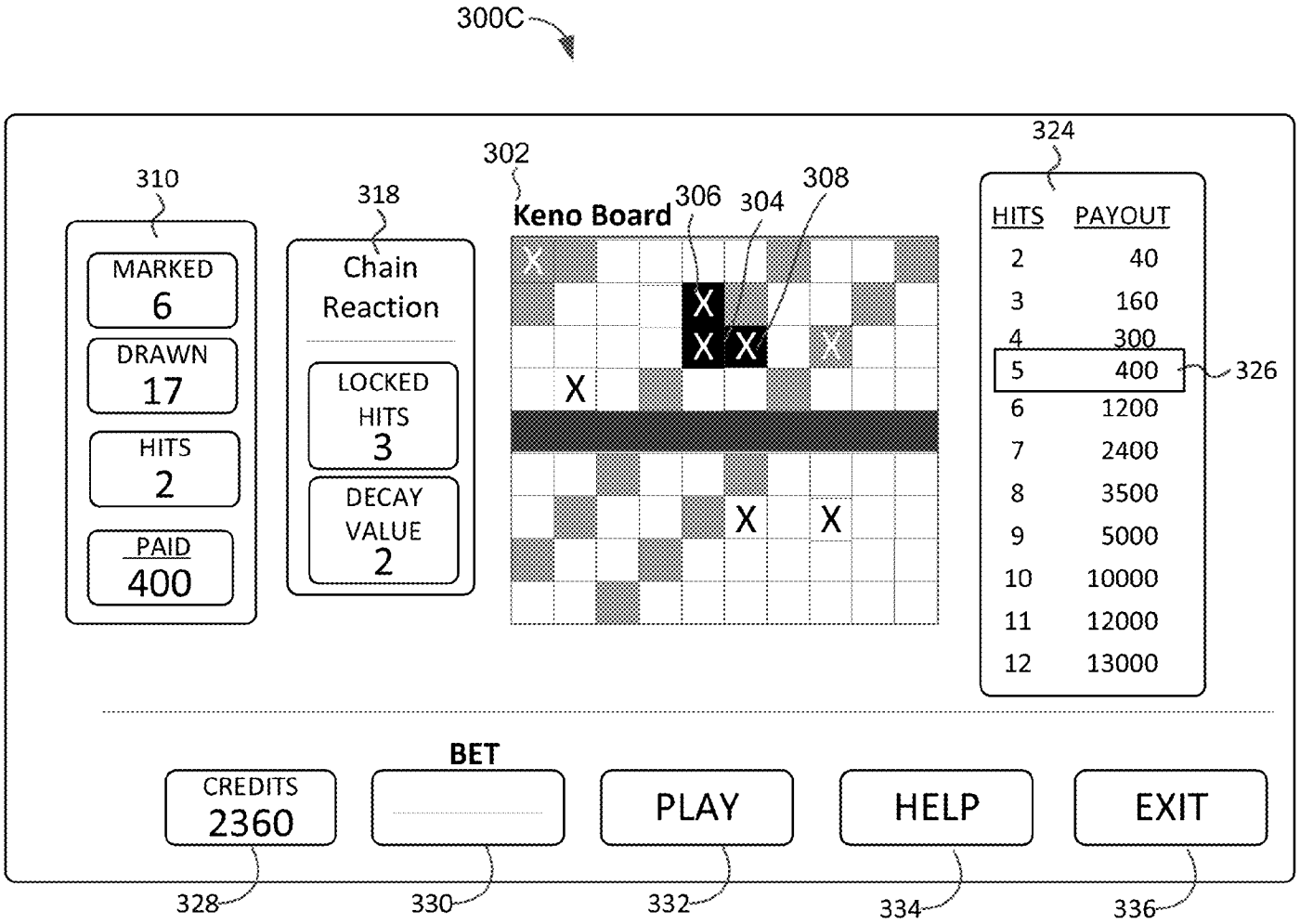

Six new player selected spots and eighteen randomly drawn spots are shown on the keno board 302 of the keno game 300C as shown in FIG. 3E. The keno board 302 displays the three hits carried over to this keno game from the previous keno game 300B. The total of drawn keno board spots is modified by the number of hits carried over to the current game from the previous keno game. In this case, because three hits are carried over from the previous keno game, the number of drawn spots is modified by three. As a result, seventeen keno board spots are drawn instead of twenty during the keno game 300C.

As shown, two of the player selected spots in the keno game 300C match the drawn spots. Thus, the player is entitled to 400 credits for the three hits that are carried over from the previous keno game 300B and for the two hits identified in the current keno game 300C. The keno game summary section 310 of the keno game 300C displays that 6 spots were marked by the player on the keno board, 18 spots were drawn, and that two new hits were detected. Furthermore, the chain reaction section 318 indicates that three hits are locked from the previous keno game 300B. As a result, the keno game summary section 310 displays that 400 credits are paid to the player in the keno game 300C. The total credits field 328 is updated to show the payout earned by the player in the previous keno game 300B. The total number of credits field 328 may be updated to reflect the payout of 400 credits earned by the player in the current keno game 300C.

After completion of the keno game 300C, the chain reaction feature activated during the keno game 300A is deactivated because the decay value is two and the hits from the keno game 300A have been now carried over to two keno games. Thus, a keno game that is subsequent to the keno game 300C will not have any of the hits carried over from the keno game 300A.

In some embodiments, the chain reaction feature may be activated again with respect to the newly identified hits during the keno game 300C. In these embodiments, the all or some of the hits identified during the keno game 300C may be carried over to multiple subsequent keno games depending on the decay value. The decay value shown in the keno game 300C may have a different value than in the keno game 300A. The decay value may be determined based on any combination of, but not limited to, the bet made by the player during the current keno game, the bets made by the player during predetermined number of previous keno games, the highest bet made during a predetermined number of previous keno games, the total number of credits earned by the player thus far, etc. In one implementation, the decay value may be a fixed or predetermined value.

Figure 4:
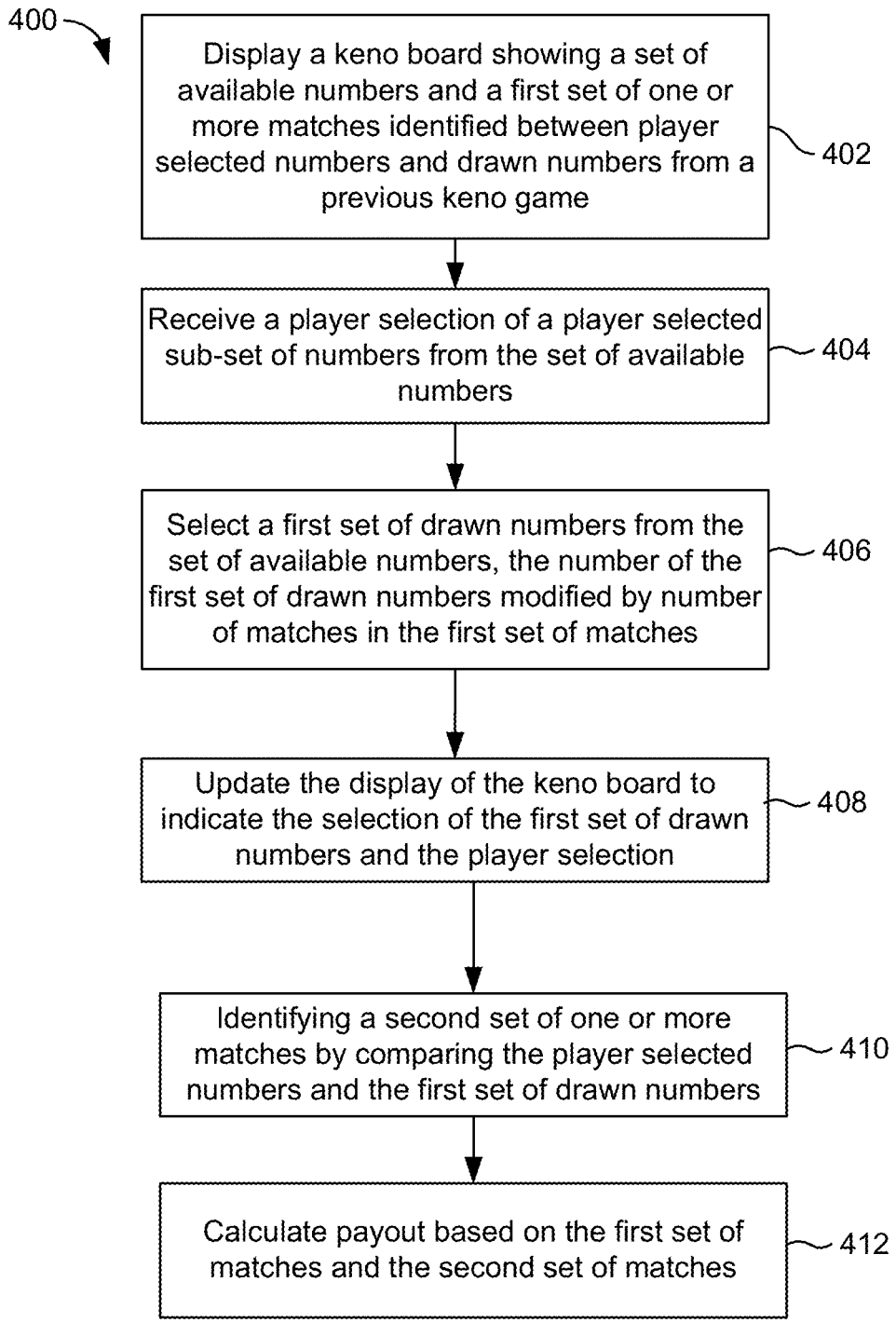
FIG. 4 is a flow diagram of a process for providing a keno game that allows for carrying over of hits between games, in an accordance with an example implementation.

FIG. 4 is a flow diagram of a process 400 for providing a keno game that allows for carrying over hits from a previous keno game to the keno game in accordance with an illustrative embodiment. The process 400 can be implemented on a computing device (e.g., a gaming machine, a user device, etc.). In one embodiment, the process 400 is encoded on a computer-readable medium that contains instructions that, when executed by the computing device, cause the computing device to perform operations of the process 400.

The process 400 includes displaying (block 402) a keno board having a set of available numbers and a first set of one or more matches identified between player selected numbers and drawn numbers from a previous keno game. In one implementation, the first set of matches may be received from a server. In another implementation, the first set of matches may be retrieved from local or remote data storage. Matches and hits are used interchangeably herein.

The set of available numbers may be visually illustrated on the keno board as numbered balls, numbered squares, or any other numbered shapes or images, etc. For example, each keno board ball may be labeled with a unique number between one and the number of available numbers (e.g., eighty). The set of available numbers includes eighty unique numbers or any other number of unique numbers (e.g., one hundred unique numbers from one to one hundred).

The first set of matches may be shown on the board by visually emphasizing the keno board spots that correspond to the matches in the first set of matches. In particular, the first set of matches may be visually emphasized on the keno board using one or more visual indicators. The matches in the first set of matches may be displayed on the keno board using predetermined colors, visual indicators, animation, and other visual effects.

At block 404, player selection of a player selected sub-set of numbers from the set of available numbers is received (block 404). The player may mark his or her selections on the keno board (e.g., by clicking or tapping on the numbers in the keno board game). The player selected numbers may be displayed as "X"s over the corresponding spots (or another shape used to display numbers on the keno board) on the keno board. The player selected numbers may equal six numbers or any other number of numbers (e.g., ten numbers). For example, the player may select six out of eighty numbers from unique numbers numbered from one to eighty. The player may request that the player selections are randomly selected by keno game for the player.

At block 406, a first set of drawn numbers is selected from the set of available numbers. In some embodiments, the first set of drawn numbers may be randomly selected without replacement from the available numbers. For example, twenty numbers may be randomly selected from available eighty numbers. In some embodiments, the first set of numbers may be randomly selected with replacement from the available numbers.

The number of the first set of drawn numbers may be modified by the number of matches in the first set of matches. In one implementation, a predetermined number of drawn numbers is modified by subtracting the number of matches in the first set of matches from the predetermined number of drawn numbers. For example, the predetermined number of drawn numbers may be twenty. In this example, during each keno game, twenty numbers are randomly drawn. If the total number of matches from the previous game is three, then the result of three being subtracted from twenty results in the number of numbers that are to be drawn in the current game. Accordingly, in this example, seventeen numbers are drawn.

At block 408, the display of the keno board is updated to indicate the selection of the first set of drawn numbers and the player selection. The keno board may be updated by marking the keno board spots corresponding to the selected first set of drawn numbers using one or more visual indicators. For example, when the keno board spots are displayed as balls labeled with numbers, then the balls on the keno board that correspond to the first set of drawn numbers may be updated to display a different color. In one implementation, the first set of drawn numbers may be displayed on the keno board as "ball drops".

The keno board is further updated to display the player selections. The player selections may be marked on the keno board as "X"s over the corresponding keno board spots as shown in FIG. 1A. Any other visual indicators can be used to identify the player selections on the keno board. In one implementation, the various visual attributes (e.g., including but not limited to, color, symbols, animation, size, shape) of the keno board spots corresponding to the player selected keno numbers may be updated.

A second set of one or more matches is identified (410) by comparing the player selected numbers and the first set of drawn numbers. The keno board may be updated to display the second set of one or more matches. Different attributes associated with the corresponding keno spots may be updated to emphasize to the user the first set of matches from the previous keno game and the second set of matches from the current keno game. In one implementation, different background colors of the corresponding keno game spots may be used to identify the matches in the first set of matches as compared to the matches in the second set of matches. For example, the color of the keno board spots corresponding to the first set of matches can be updated to grey, while the color of the keno board spots corresponding to the second set of matches can be updated to black.

The payout due to the player may be calculated (412) based on both the first set of matches and the second set of matches. In one implementation, the number of matches in the first set of matches is added to the number of matches in the second set of matches. For example, two matches may be carried over from the previous game, and three matches are detected in the current game. In this example, the player is paid based on the total number of five matches in accordance with a paytable.

The second set of matches may be carried over to a subsequent keno game and used for determining payout to the player in the subsequent keno game. In some embodiments, the first set of matches carried over from the previous keno game can be carried over to multiple subsequent keno games. In these embodiments, the total number of matches carried over decreases by one with each subsequent game. FIGS. 2A-G illustrate four matches identified during an initial keno game, and these four matches carrying over to three subsequent games, with a second keno game displaying three of the four matches from the initial keno game, a third keno game displaying two of the four matches from the initial keno game, and the fourth keno game displaying one of the matches from the initial keno game.

In some implementations, a decay value may be utilized to dictate the number of games to which identified matches in a keno game can be carried over. For example, if the decay value is five, then all the matches (or "hits) from the current keno games are carried over to the next five keno games. In this example, a second keno game may display the five matches from the initial keno games, a third keno game may display the five matches from the initial keno game, a fourth keno game may display the five matches from the initial keno game, a fifth keno game may display the five matches from the initial keno game, and a sixth keno game may display the five matches from the initial keno game. FIGS. 3A-E illustrate keno games in which a decay value is utilized.

Figure 5:
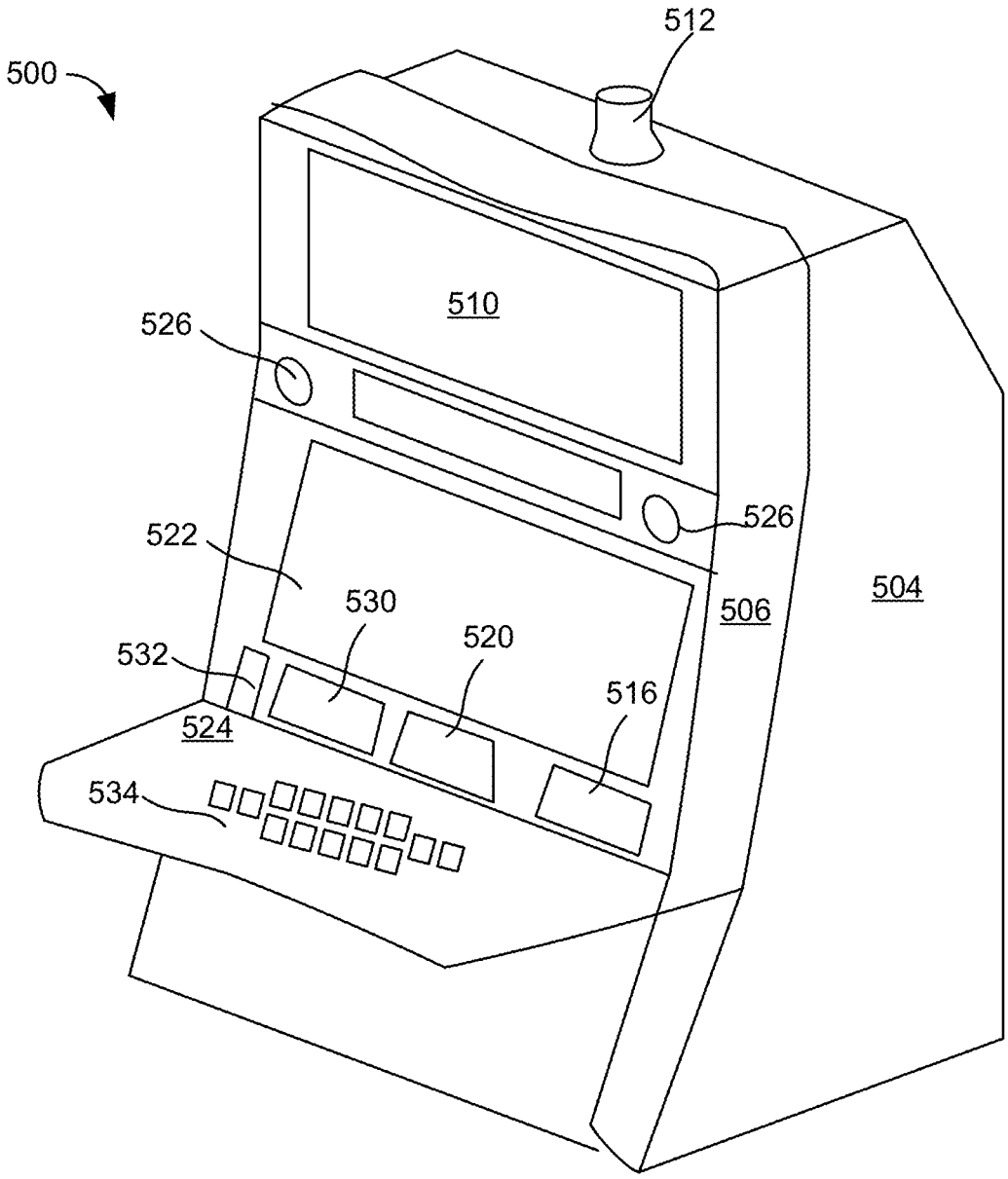
FIG. 5 is a diagram of an electronic gaming machine that can be used to play the keno game, in an accordance with an example implementation.

Referring to FIG. 5, a perspective drawing of an electronic gaming machine 500 is shown in accordance with described embodiments. The gaming machine 500 may include a main cabinet 504. The main cabinet 504 may provide a secure enclosure that prevents tampering with device components, such as a game controller (not shown) located within the interior of the main cabinet 504. The main cabinet 504 may include an access mechanism, such as a door 506, which allows the interior of the gaming machine 500 to be accessed. Actuation of the door 506 may be controlled by a locking mechanism. In some embodiments, the locking mechanism, the door 506, and the interior of main cabinet 504 may be monitored with security sensors of various types to detect whether the interior has been accessed. For instance, a light sensor may be provided within the main cabinet 504 to detect a change in light-levels when the door 506 is opened and/or an accelerometer may be attached to the door 506 to detect when the door 506 is opened.

The gaming machine 500 may include any number of user interface devices that convey sensory information to a user and/or receive input from the user. For example, the gaming machine 500 may include electronic displays 540 and/or 522, speakers 526, and/or a candle device 512 to convey information to the user of the gaming machine 500. The gaming machine 500 may also include a console 524 having one or more inputs (e.g., buttons, track pads, etc.) configured to receive input from a user. In one embodiment, the display 510 and/or the display 522 may be a touch screen display configured to receive input from a user. A controller (not shown) within the gaming machine 500 may run a game, such as a wager-based game (e.g., a keno game), in response to receiving input from a user via inputs located in the console 524, display 522, or display 510. For example, inputs located in the console 524 may be operated to place a wager in the game and to run the game. In response, the controller may cause the display 522 to show a wager-based game such as a keno game.

The gaming machine 500 may also include devices for conducting a wager-based game. For example, the gaming machine 500 may include a ticket acceptor 516 and a printer 520. In various embodiments, the gaming machine 500 may be configured to run on credits that may be redeemed for money and/or other forms of prizes. The ticket acceptor 516 may read an inserted ticket having one or more credits usable to play a game on the gaming machine 500. For example, a player of the gaming machine 500 may wager one or more credits within a video keno game. If the player loses, the wagered amount may be deducted from the player's remaining balance on the gaming machine 500. However, if the player wins and is awarded an award, the player's balance may be increased by the amount won and/or awarded. Any remaining credit balance on the gaming machine 500 may be converted into a ticket via the printer 520. For example, a player of the gaming machine 500 may cash out of the machine by selecting to print a ticket via the printer 520. The ticket may then be used to play other gaming machines or redeemed for cash and/or prizes. According to various embodiments, the gaming machine 500 may record data regarding its receipt and/or disbursement of credits.

In one embodiment, the gaming machine 500 may include a loyalty card acceptor 530. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing the gaming machine 500. For example, a user having a loyalty account may be given an award turn on the gaming machine 500 or credited loyalty points for playing the gaming machine 500. Such loyalty points may be exchanged for loyalty rewards (e.g., a free meal, a free hotel stay, free room upgrade, discounts, etc.).

Implementations of the subject matter and the operations described in this specification can be implemented in digital electronic circuitry, computer software, firmware or hardware, including the structures disclosed in this specification and their structural equivalents or in combinations of one or more of them. Implementations of the subject matter described in this specification can be implemented as one or more computer programs, i.e., one or more modules of computer program instructions, encoded on one or more computer storage medium for execution by, or to control the operation of data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing apparatus on data stored on one or more computer-readable storage devices or received from other sources.

The term "client or "server" includes a variety of apparatuses, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, a code that creates an execution environment for the computer program in question, e.g., a code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions (e.g., directing, controlling, updating the display device) in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, or a portable storage device (e.g., a universal serial bus (USB) flash drive). Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well. For example, feedback provided to the user can be any form of sensory feedback, e.g., visual feedback, auditory feedback, or tactile feedback and input from the user can be received in any form, including acoustic, speech, or tactile input. In addition, a computer can interact with a user by sending documents to and receiving documents from a device that is used by the user. For example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown, in sequential order or that all illustrated operations be performed to achieve desirable results. In certain circumstances, multitasking and parallel processing may be advantageous. Moreover, the separation of various system components in the implementations described above should not be understood as requiring such separation in all implementations and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

What is claimed is:

1. A method of operating a gaming system, the method comprising:

receiving, by an acceptor of the gaming system, a physical item associated with a monetary value;

establishing, by one or more processors, a credit balance based at least in part on the monetary value associated with the received physical item;

receiving an actuation of a wager button;

placing, by the one or more processors, a wager responsive to receipt of the actuation of the wager button, the credit balance decreasable by the wager;

displaying, by at least one display device, a keno board having a set of available numbers;

displaying, by the at least one display device and for each match of a first set of one or more matches identified between a first player selected sub-set of numbers and first set of drawn numbers from a previous keno game, an indication of that match;

receiving, by at least one input device, a player selection of a second player selected sub-set of numbers from the set of available numbers;

selecting, by the one or more processors, a second set of drawn numbers from the set of available numbers, a quantity of numbers in the second set of drawn numbers determined based on a quantity of matches in the first set of one or more matches;

displaying, by the at least one display device, indications of the second set of drawn numbers and the second player selected sub-set of numbers;

identifying, by the one or more processors, any second matches by comparing the second set of drawn numbers and the second player selected sub-set of numbers;

determining, by the one or more processors, any awards based on the first set of one or more matches and any second matches, the credit balance being increasable by any determined awards;

receiving an actuation of a cashout button; and initiating, by the one or more processors, a payout responsive to receipt of the actuation of the cashout button.

2. The method of claim 1, wherein determining, by the one or more processors, any awards includes adding the quantity of matches in the first set of one or more matches to a total quantity of second matches, wherein a paytable is used to determine the payout based on the result of adding the matches.

3. The method of claim 1, further comprising receiving, by the at least one input device, a player selection to play a second keno game play;

displaying, by the at least one display device, the keno board including indications of any second matches and not of any matches of the first set of one or more matches;

receiving, by the at least one input device, a player selection of a third player selected sub-set of numbers from the set of available numbers;

selecting, by the one or more processors, a third set of drawn numbers from the set of available numbers, a quantity of numbers in the third set of drawn numbers determined based on a total quantity of second matches;

displaying, by the at least one display device, indications of the third set of drawn numbers and the third player selected sub-set of numbers;

identifying, by the one or more processors, any third matches by comparing the third set of drawn numbers and the third player selected sub-set of numbers; and determining, by the one or more processors, any awards based on the second matches and the third matches.

4. The method of claim 3, wherein when there are no third matches, no matches are carried over to a subsequent keno game after the second keno game.

5. The method of claim 1, wherein a decay value associated with the previous keno game identifies a number of games to which the first set of one or more matches is carried over.

6. The method of claim 5, wherein the decay value is more than two.

7. The method of claim 5, wherein the first set of one or more matches includes one fewer match than a total quantity of matches in the previous keno game.

8. The method of claim 7, which includes randomly determining, by the one or more processors, which match from the previous keno game is not carried over to the subsequent keno game.

9. The method of claim 1, which includes determining, by the one or more processors, the quantity of numbers in the second set of drawn numbers by subtracting, by the one or more processors, the quantity of matches in the first set of one or more matches from a predetermined number.

10. A gaming system comprising:

a housing;

a display device supported by the housing;

a plurality of input devices supported by the housing and including an acceptor; and a game controller having one or more data processors and one or more storage devices storing instructions that, when executed by the one or more data processors, cause the one or more data processors to operate with the display device and the plurality of input devices to:

establish a credit balance based at least in part on a monetary value associated with a physical item after the physical item is received by the acceptor;

place a wager following receipt of an actuation of a wager button, the credit balance being decreasable by the wager;

display a keno board having a set of available numbers;

display, for each match of a first set of one or more matches identified between a first player selected sub-set of numbers and a first set of drawn numbers from a previous keno game, an indication of that match;

select a second set of drawn numbers from the set of available numbers, a quantity of numbers in the second set of drawn numbers determined based on a quantity of matches in the first set of one or more matches;

display indications of the second set of drawn numbers and a second player selected sub-set of numbers;

identify any second matches by comparing the second set of drawn numbers and the second player selected sub-set of numbers;

determine any awards based on the first set of one or more matches and any second matches, the credit balance being increasable by any awards; and initiate a payout associated with the credit balance following receipt of an actuation of a cashout button.

11. The gaming system of claim 10, wherein the instructions, when executed by the one or more data processors, cause the one or more data processors to determine any awards by adding the quantity of matches in the first set of one or more matches to a total quantity of second matches, wherein a paytable is used to determine the payout based on the result of adding the matches.

12. The gaming system of claim 11, wherein when there are no third matches, no matches are carried over to a subsequent keno game after the second keno game.

13. The gaming system of claim 12, wherein the decay value is more than two.

14. The gaming system of claim 12, wherein the first set of matches includes one fewer match than a total quantity of matches in the previous keno game.

15. The gaming system of claim 13, wherein the instructions, when executed by the one or more data processors, cause the one or more data processors to randomly determine which match from the previous keno game is not carried over to the subsequent keno game.

16. The gaming system of claim 10, wherein the instructions, when executed by the one or more data processors, cause the one or more data processors to operate with the at least one display device and the plurality of input devices to, after receiving a player selection to play a second keno game play:

display the keno board including indications of any second matches and not of any matches of the first set of one or more matches;

select a third set of drawn numbers from the set of available numbers, a quantity of numbers in the third set of drawn numbers determined based on a total quantity of second matches;

display indications of the third set of drawn numbers and a third player selected sub-set of numbers;

identify any third matches by comparing the third set of drawn numbers and the third player selected sub-set of numbers; and determine any awards based on the second matches and any third matches.

17. The gaming system of claim 10, wherein a decay value associated with the previous keno game identifies a number of games to which the first set of one or more matches is carried over.

18. The gaming system of claim 10, wherein the instructions, when executed by the one or more data processors, cause the one or more data processors to determine the quantity of numbers in the second set of drawn numbers by subtracting the quantity of matches in the first set of one or more matches from a predetermined number.

19. A non-transitory computer-readable storage medium having machine instructions stored therein, the instructions being executable by a processor to cause the processor to:

establish a credit balance based at least in part on a monetary value associated with a physical item after the physical item is received by an acceptor;

place a wager following receipt of an actuation of a wager button, the credit balance being decreasable by the wager;

cause at least one display device to display a keno board having a set of available numbers;

cause the at least one display device to display, for each match of a first set of one or more matches identified between a first player selected sub-set of numbers and a first set of drawn numbers from a previous keno game, an indication of that match;

select a second set of drawn numbers from the set of available numbers, a quantity of numbers in the second set of drawn numbers determined based on a quantity of matches in the first set of one or more matches;

cause the at least one display device to display indications of the second set of drawn numbers and a second player selected sub-set of numbers;

identify any second matches by comparing the second set of drawn numbers and the second player selected sub-set of numbers;

determine any awards payout based on the first set of one or more matches and any second matches, the credit balance being increasable by any determined awards; and initiate a payout associated with the credit balance following receipt of an actuation of a cashout button.

20. The computer-readable storage medium of claim 19, wherein a decay value associated with the previous keno game identifies a number of games to which the first set of one or more matches is carried over.

* * * * *